US011049680B2

(12) United States Patent
Urrea et al.

(10) Patent No.: US 11,049,680 B2
(45) Date of Patent: Jun. 29, 2021

(54) LOW PROFILE INTEGRATED FUSE MODULE

(71) Applicant: Littelfuse, Inc., Chicago, IL (US)

(72) Inventors: Julio Urrea, Hudson, OH (US); Gary Bold, Palatine, IL (US); Hector Perez, Coahuila (MX); Matt Yurkanin, Mount Prospect, IL (US); Alexander Conrad, Braunfels (DE)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/638,378

(22) PCT Filed: Sep. 10, 2018

(86) PCT No.: PCT/US2018/050202
§ 371 (c)(1),
(2) Date: Feb. 11, 2020

(87) PCT Pub. No.: WO2019/051375
PCT Pub. Date: Mar. 14, 2019

(65) Prior Publication Data

US 2020/0365358 A1 Nov. 19, 2020

Related U.S. Application Data

(60) Provisional application No. 62/635,903, filed on Feb. 27, 2018, provisional application No. 62/555,741, filed on Sep. 8, 2017.

(51) Int. Cl.
*H01H 85/143* (2006.01)
*H01H 85/20* (2006.01)
(Continued)

(52) U.S. Cl.
CPC ..... *H01H 85/0411* (2013.01); *H01H 85/055* (2013.01); *H01H 85/143* (2013.01);
(Continued)

(58) Field of Classification Search
CPC .. H01H 85/0411; H01H 85/143; H01H 85/20; H01H 85/055; H01H 85/2045;
(Continued)

(56) References Cited

U.S. PATENT DOCUMENTS 5,643,693 A * 7/1997 Hill ..... H01M 2/348 429/121
7,568,921 B2 8/2009 Pavlovic et al.
(Continued)

FOREIGN PATENT DOCUMENTS

| | | | |
|---|---|---|---|
| EP | 0924734 | A1 | 6/1999 |
| JP | 2010218687 | A | 9/2010 |
| WO | 2016114068 | A1 | 7/2016 |

OTHER PUBLICATIONS

International Search Report and Written Opinion dated Nov. 8, 2018, for PCT application, PCT/US2018/050202 filed Sep. 10, 2018.

*Primary Examiner* — Stephen S Sul
(74) *Attorney, Agent, or Firm* — Kacvinsky Daisak Bluni PLLC

(57) ABSTRACT

A fuse module including a mounting block formed of an electrically insulating material, the mounting block including a rear wall extending from a base, a fuse plate including an electrically conductive bus bar disposed on a bottom of the base, a fusible element electrically connected to the bus bar and disposed adjacent a rear of the rear wall, and a fuse terminal electrically connected to the fusible element and extending over a top of the rear wall, along a front of the rear wall, and onto a top of the base, the fuse module further including an electrically conductive terminal post extending from the top of the base through the fuse terminal for facilitating connection to an electrical component.

15 Claims, 26 Drawing Sheets

(51) Int. Cl.
*H01H 85/041* (2006.01)
*H01H 85/055* (2006.01)

(52) U.S. Cl.
CPC ..... *H01H 85/20* (2013.01); *H01H 85/205* (2013.01); *H01H 85/2045* (2013.01); *H01H 2085/208* (2013.01); *H01H 2085/2055* (2013.01)

(58) Field of Classification Search
CPC ..... H01H 85/205; H01H 2085/2055; H01H 2085/208; H01H 85/12; H01H 85/08; H01H 2085/0555
USPC ..... 337/186, 187, 208, 227, 188; 439/620.26, 620.29
See application file for complete search history.

(56) References Cited

U.S. PATENT DOCUMENTS 7,663,466 B1 2/2010 Jetton
7,990,738 B2 8/2011 Urrea et al.
8,665,056 B2 3/2014 Urrea et al.
8,669,840 B2 3/2014 Urrea et al.
9,384,929 B2 * 7/2016 Masuda ..... H01H 85/044
9,425,018 B2 * 8/2016 Nohara ..... H01H 85/201
9,824,840 B2 11/2017 Schwartz et al.
9,842,718 B1 * 12/2017 Carnick ..... H01H 85/0241
10,276,337 B2 4/2019 Doering et al.
10,283,916 B2 5/2019 Urrea et al.
10,510,507 B2 * 12/2019 Kitano ..... H01H 85/20
2005/0116806 A1 * 6/2005 Iwata ..... H01H 85/30 337/188
2009/0251200 A1 10/2009 Urrea et al.
2011/0285496 A1 * 11/2011 Urrea ..... H01H 85/12 337/188
2012/0188050 A1 7/2012 Nohara
2012/0302098 A1 * 11/2012 Matsumoto ..... H01H 85/12 439/620.26
2013/0027174 A1 1/2013 Masuda et al.
2013/0273404 A1 * 10/2013 Ochi ..... H01M 2/14 429/99
2013/0316584 A1 11/2013 Taguchi et al.
2014/0094062 A1 * 4/2014 Onoda ..... H01R 13/68 439/620.26
2016/0064887 A1 * 3/2016 Ishikawa ..... H01R 43/16 264/138
2016/0071678 A1 3/2016 Schwartz et al.
2016/0204555 A1 7/2016 Sueyoshi et al.
2018/0108506 A1 4/2018 Doering et al.
2020/0185180 A1 * 6/2020 Urrea ..... H01H 85/055

* cited by examiner

LOW PROFILE INTEGRATED FUSE MODULE

CROSS-REFERENCES TO RELATED APPLICATIONS

This application claims the benefit of U.S. Provisional Patent Application No. 62/555,741, filed Sep. 8, 2017, and U.S. Provisional Patent Application No. 62/635,903, filed Feb. 27, 2018, both of which are incorporated by reference herein in their entireties.

FIELD OF THE DISCLOSURE

The disclosure relates generally to the field of circuit protection devices and relates more particularly to a low profile integrated fuse module suitable for automotive battery applications.

BACKGROUND OF THE DISCLOSURE

In the global automotive market there has been a trend toward implementing so-called "pre-fuse boxes" that are disposed within automobile engine compartments and connected to automobile battery terminals. The primary purpose of a pre-fuse box in an automobile is to prevent electrical damage that may result from short-circuiting in high-current-conducting wires, such as may occur in the event of an accident.

Existing pre-fuse boxes are typically quite large and are mounted adjacent automobile batteries with flexible, conductive leads providing electrical connections therebetween. This type of arrangement requires a great deal of space within an automobile engine compartment where space is already very limited. In some implementations, a pre-fuse box may be connected directly to a terminal of an automobile battery, with a substantial portion of the pre-fuse box hanging off of the side of the battery so that the pre-fuse box does not extend into a required, empty "pedestrian protection zone" above the battery and below the hood of an automobile. However, such "hanging" configurations necessitate strain relief features in the pre-fuse box that increase design complexity and cost.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A fuse module in accordance with an exemplary embodiment of the present disclosure may include a mounting block formed of an electrically insulating material, the mounting block including a rear wall extending from a base, a fuse plate including an electrically conductive bus bar disposed on a bottom of the base, a fusible element electrically connected to the bus bar and disposed adjacent a rear of the rear wall, and a fuse terminal electrically connected to the fusible element and extending over a top of the rear wall, along a front of the rear wall, and onto a top of the base, the fuse module further including an electrically conductive terminal post extending from the top of the base through the fuse terminal for facilitating connection to an electrical component.

Another fuse module in accordance with an exemplary embodiment of the present disclosure may include a mounting block formed of an electrically insulating material and having a trough formed in a top surface thereof, a fuse plate including an electrically conductive bus bar disposed on a bottom of the mounting block, a fusible element electrically connected to the bus bar and extending over the trough, and a fuse terminal disposed on the top surface of the mounting block and electrically connected to the fusible element, the fuse module further including an electrically conductive terminal post extending from the mounting block through the fuse terminal for facilitating connection to an electrical component.

Another fuse module in accordance with an exemplary embodiment of the present disclosure may include a mounting block formed of an electrically insulating material, the mounting block including a rear wall extending from a base, a fuse plate including an electrically conductive bus bar disposed on a bottom of the base, a fusible element electrically connected to the bus bar and disposed adjacent a rear of the rear wall, and a fuse terminal electrically connected to the fusible element and extending over a top of the rear wall, along a front of the rear wall, and onto a top of the base, the fuse module further including a tubular sleeve disposed within the base between, and in contact with, the bus bar and the fuse terminal, wherein an aperture extends through the bus bar, the tubular sleeve, and the fuse terminal.

DETAILED DESCRIPTION

A low profile integrated fuse module in accordance with the present disclosure will now be described more fully with reference to the accompanying drawings, in which preferred embodiments of the fuse module are presented. It will be understood, however, that the fuse module may be embodied in many different forms and should not be construed as being limited to the embodiments set forth herein. Rather, these embodiments are provided so that this disclosure will convey certain exemplary aspects of the fuse module to those skilled in the art.

Figure 1:
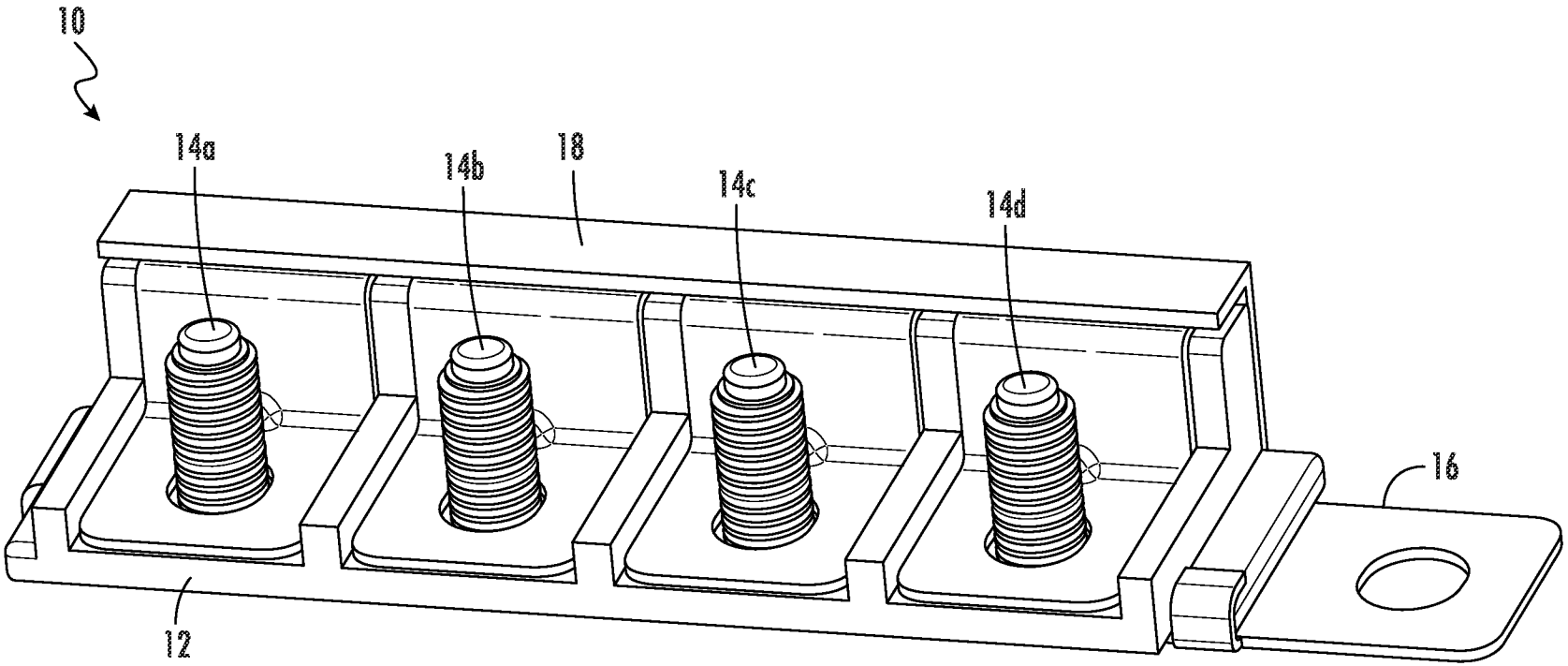
FIG. 1 is a front perspective view illustrating a fuse module in accordance with an exemplary embodiment of the present disclosure.

Referring to FIG. 1, a perspective view illustrating a low profile integrated fuse module 10 (hereinafter "the fuse module 10") in accordance with an exemplary, non-limiting embodiment of the present disclosure is shown. As will be described in greater detail below, the fuse module 10 may be coupled directly to a positive terminal of an automobile battery with no flexible electrical conductors extending therebetween, and may provide overcurrent protection for a plurality of electrical loads that are powered by the battery. Advantageously, the fuse module 10 has a low profile and includes an integrated mounting structure that allows the fuse module 10 to be implemented in a compact, space-saving form factor relative to pre-fuse boxes that are currently available on the market.

For the sake of convenience and clarity, terms such as "front," "rear," "top," "bottom," "up," "down," "vertical," and "horizontal" may be used herein to describe the relative placement and orientation of various components of the fuse module 10, each with respect to the geometry and orientation of the fuse module 10 as it appears in FIG. 1. Said terminology will include the words specifically mentioned, derivatives thereof, and words of similar import.

Figure 2A:
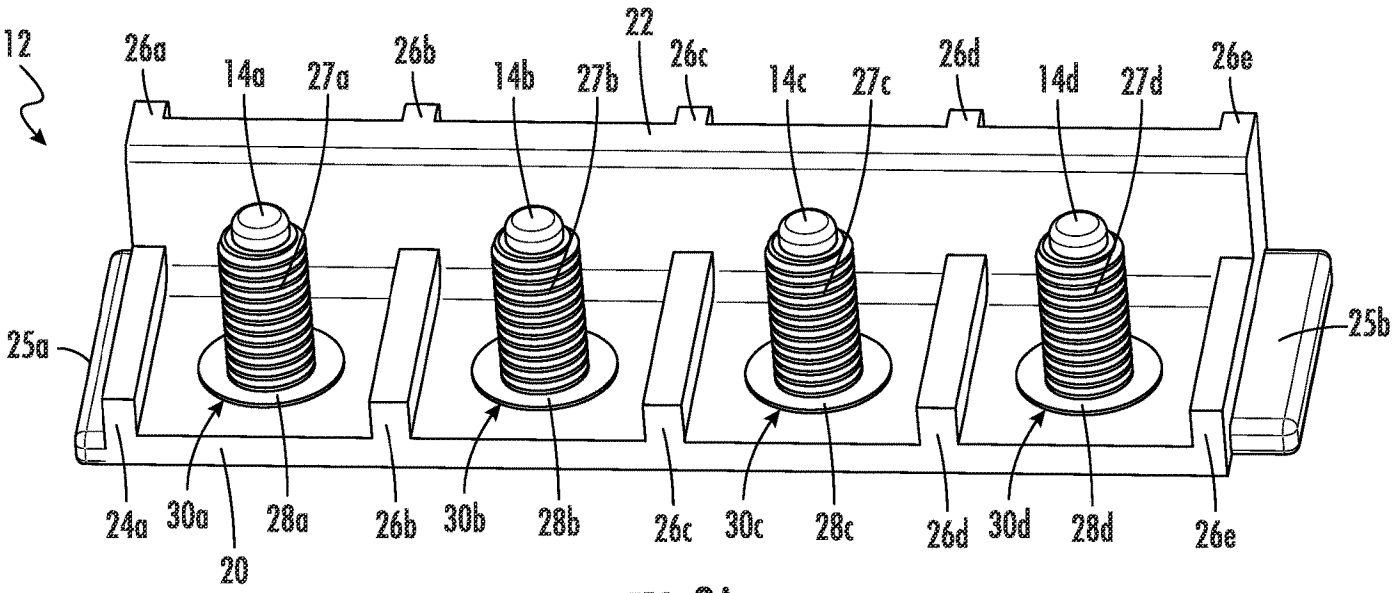
FIG. 2*a* is a perspective view illustrating a mounting block and terminal posts of the fuse module shown in FIG. 1.
Figure 2B:
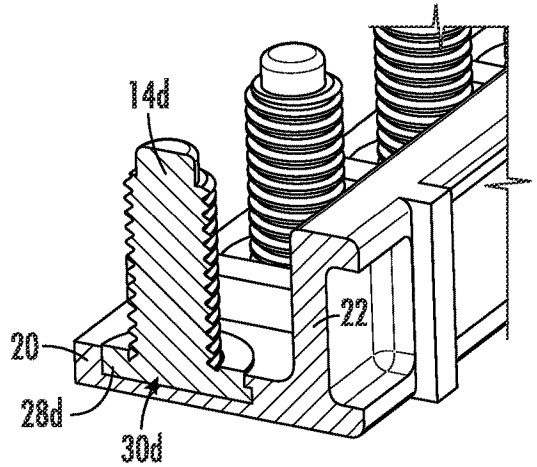
FIG. 2*b* is a cross sectional view illustrating the mounting block and terminal posts of the fuse module shown in FIG. 2*a;*

The fuse module 10 may generally include a mounting block 12, a plurality of terminal posts 14*a-d*, a fuse plate 16, and a cover 18. Referring to FIG. 2*a*, a perspective view illustrating the mounting block 12 and the terminal posts 14*a-d* is shown with the fuse plate 16 and the cover 18 omitted for clarity. The mounting block 12 may be an elongate body formed of an electrically insulting material (e.g., plastic, polymer, etc.), and may generally include a base 20 and a rear wall 22 that adjoin one another at a right angle to define a substantially L-shaped cross section as best shown in FIG. 2*b*. A plurality of base ridges 24*a-e* and rear wall ridges 26*a-e* may extend from the top surface of the base 20 and the rear surface of the rear wall 22, respectively, horizontally intermediate and/or adjacent the terminal posts 14*a-d*. The mounting block 12 may further include substantially planar crimping flanges 25*a, b* extending from longitudinal ends thereof.

Figure 2C:
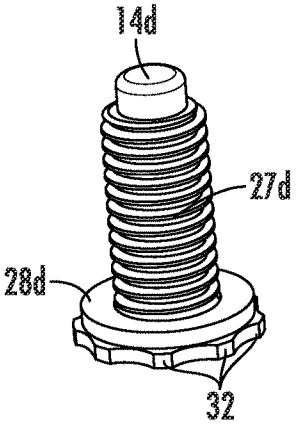
FIG. 2*c* is a detailed perspective view illustrating a terminal post of the fuse module shown in FIG. 1.

The terminal posts 14*a-d* may be disposed intermediate the base ridges 24*a-e* and may extend vertically from the top surface of the base 20 to a height substantially equal to that of the rear wall 22. The terminal posts 14*a-d* may include respective threaded shafts 27*a-d* with respective mounting flanges 28*a-d* extending from lower ends thereof. The mounting flanges 28*a-d* may be disposed within respective cavities 30*a-d* in the base 20 as best shown in FIG. 2*b*. The top surfaces of the flanges 28*a-d* may be exposed and may be substantially coplanar with, or disposed slightly above, the top surface of the base 20. In one example, the base 20 of the mounting block 12 may be over molded onto the flanges 28*a-d*. The flanges 28*a-d* may include radial protrusions 32 (see FIG. 2*c*), similar to the teeth of a gear, which may prevent rotation of the flanges 28*a-d* within the cavities 30*a-d*.

Figure 3:
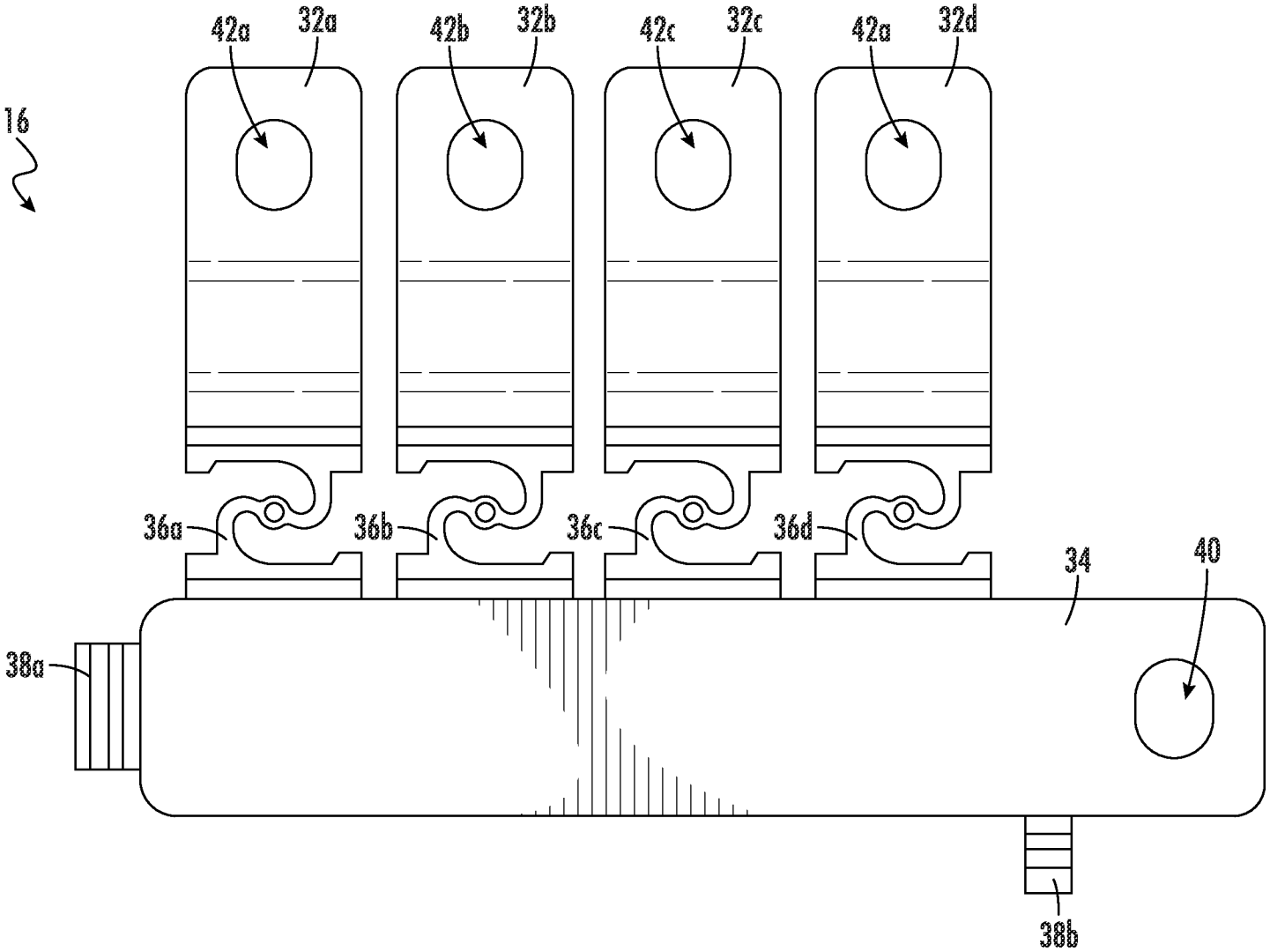
FIG. 3 is a plan view illustrating a fuse plate of the fuse module shown in FIG. 1.

Referring to FIG. 3, a plan view illustrating the fuse plate 16 in isolation and in an unassembled state is shown. The fuse plate 16 may be formed from a single piece of conductive material (e.g., stamped from a sheet of copper) and may include a plurality of fuse terminals 32*a-d* connected to a bus bar 34 by respective fusible elements 36*a-d*. The fuse plate 16 is depicted as including four fuse terminals 32*a-d* and four fusible elements 36*a-d*, but this is not intended to be limiting, and it is contemplated that the fuse plate 16 may include a fewer number (as few as one) or a greater number of fuse terminals and fusible elements without departing from the present disclosure. In a non-limiting, exemplary embodiment, fuse plate 16 may be formed of 1-millimeter-thick copper sheet, and each of the fusible elements 36*a-d* may have a rating of 80 amps. It will be appreciated that the fuse plate 16 is not limited in this regard, and that the fuse plate 16 may be formed of various other conductive materials and/or with different thicknesses to achieve different current ratings in the fusible elements 36*a-d*.

The fuse plate 16 may further include first and second crimping tabs 38*a, b* extending from a rear and a longitudinal end of the bus bar 34, respectively. The bus bar 34 may further include a mounting aperture 40 formed therethrough adjacent a longitudinal end thereof, and the fuse terminals 32*a-d* may include respective mounting apertures 42*a-d* formed therethrough.

Figure 4A:
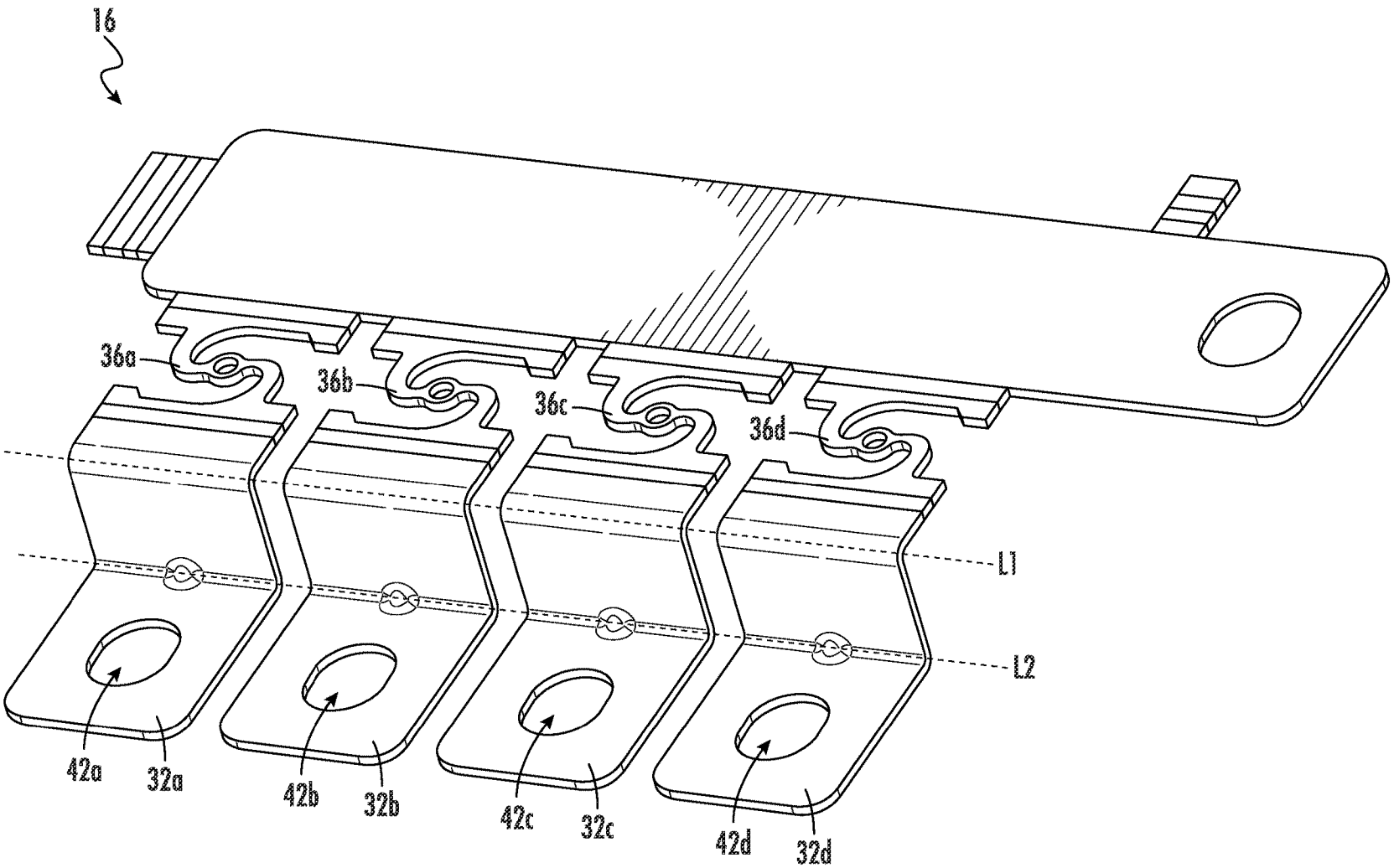
FIGS. 4*a*-4*e* are a series of perspective views illustrating a manner in which the fuse plate shown in FIG. 3 may be bent or folded during assembly of the fuse module 10 shown in FIG. 1.

During assembly of the fuse module 10, the fuse plate 16 may be bent or folded such that the fuse plate 16 may be wrapped about, and secured to, the mounting block 12 in a substantially conformal relationship with various surfaces thereof. For example, referring to FIGS. 4*a*-4*e*, a series of views are presented that illustrate one manner in which the fuse plate 16 may be bent or folded during assembly of the fuse module 10. Specifically, in a first assembly step shown in FIG. 4*a*, the fuse terminals 32*a-d* may be bent or folded 90 degrees in a first direction about a first fold line L1 that is parallel to the bus bar 34 and that is proximate the fusible elements 36*a-d*, and may be bent or folder 90 degrees in a second direction opposite the first direction about a second fold line L2 that is parallel to the bus bar 34 and that is intermediate the first fold line L1 and the mounting apertures 42*a-d*.

Figure 4B:
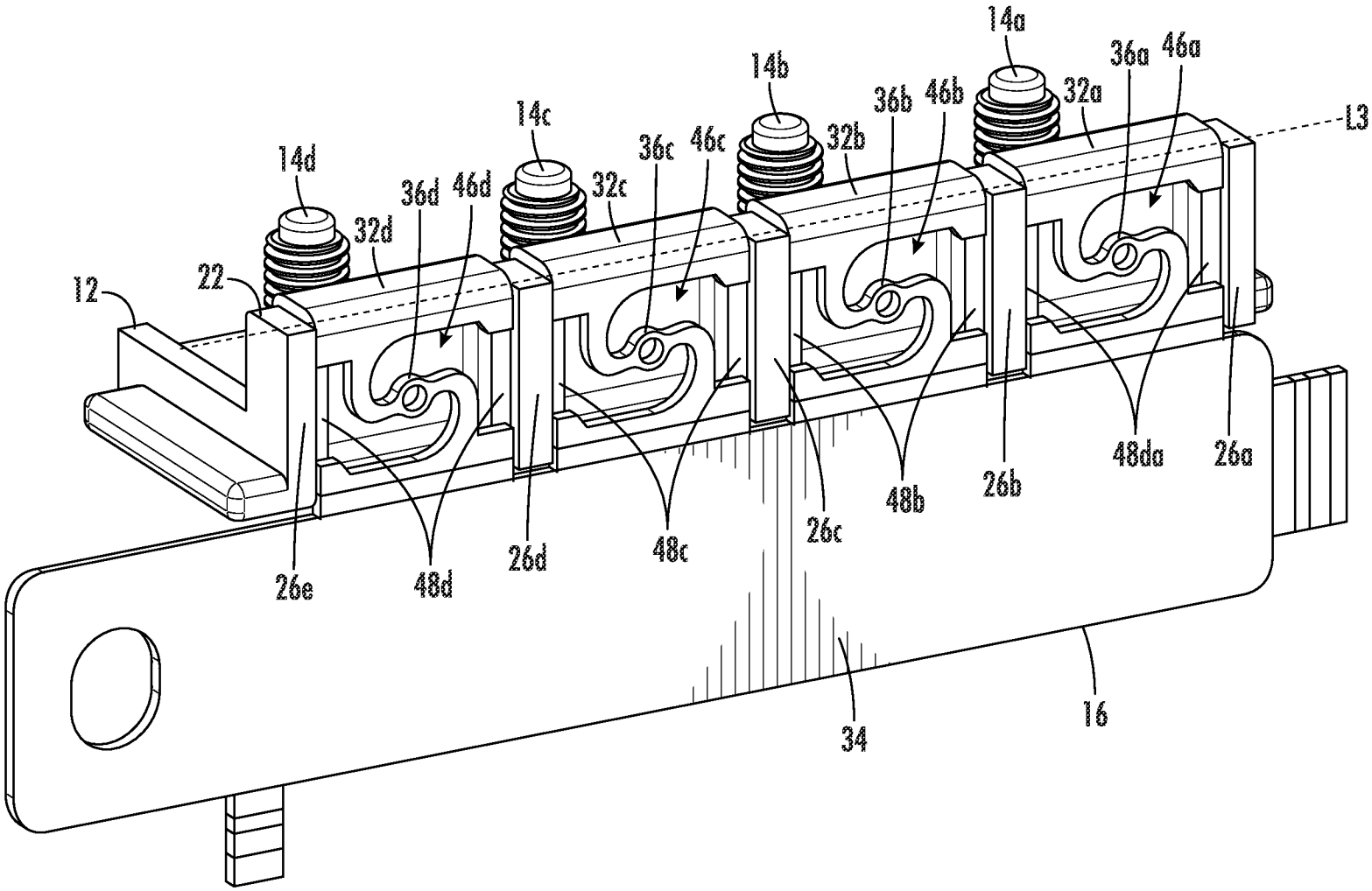

In a second assembly step shown in FIG. 4*b*, the fuse plate 16 may be placed on the mounting block 12 with the bent fuse terminals 32*a-d* disposed in engagement with the top surface of the base 20 and the front surface of the rear wall 22, and with the terminal posts 14*a-d* extending through the mounting apertures 42*a-d* (not within view), respectively. With the fuse plate 16 positioned thusly, the fuse terminals 32*a-d* may be bent or folded 90 degrees about a third fold line L3 that is parallel to the bus bar 34 and that is intermediate the first fold line L1 (see FIG. 4*a*) and the fusible elements 36*a-d*. The fusible elements 36*a-d* may extend over respective recesses 46*a-d* defined by, and located intermediate, respective pairs of the rear wall ridges 26*a-e*, with the fusible elements 36*a-d* spaced apart from the rear surface of the rear wall 22 by respective pairs of shoulders 48*a-d* that extend from the rear surface of the rear wall 22 inward of the rear wall ridges 26*a-e*. While the fusible elements 36*a-d* are shown and described herein as being disposed behind and adjacent the rear surface of the rear wall, various alternative embodiments of the present disclosure are contemplated in which one or more of the fusible elements 36*a-d* may be disposed in front of and adjacent the front surface of the rear wall 22.

Figure 4C:
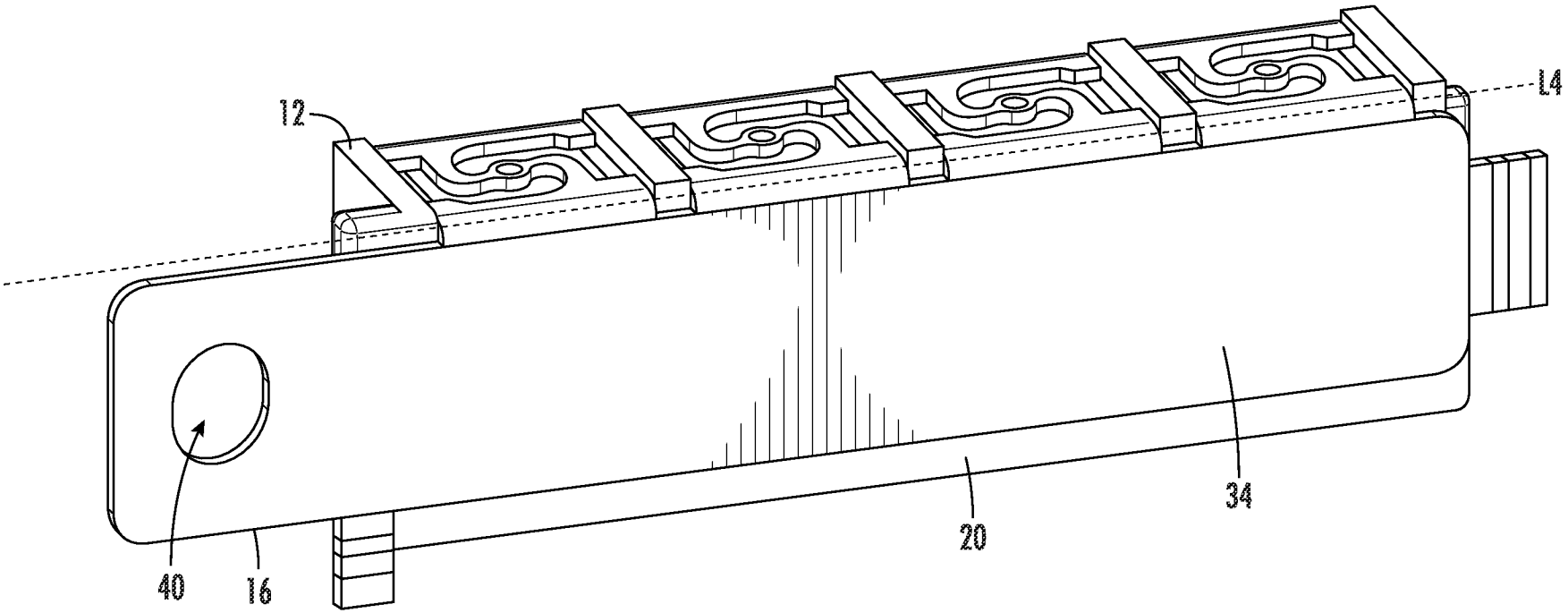

In a third assembly step shown in FIG. 4*c*, the fuse plate 16 may be bent or folded 90 degrees about a fourth fold line L4 that is parallel to the bus bar 34 and intermediate the first fold line L1 and the bus bar 34. The bus bar 34 may thus be disposed in flat abutment with the bottom surface of the base 20 with the mounting aperture 40 of the bus bar 34 located beyond a longitudinal end of the base 20.

Figure 4D:
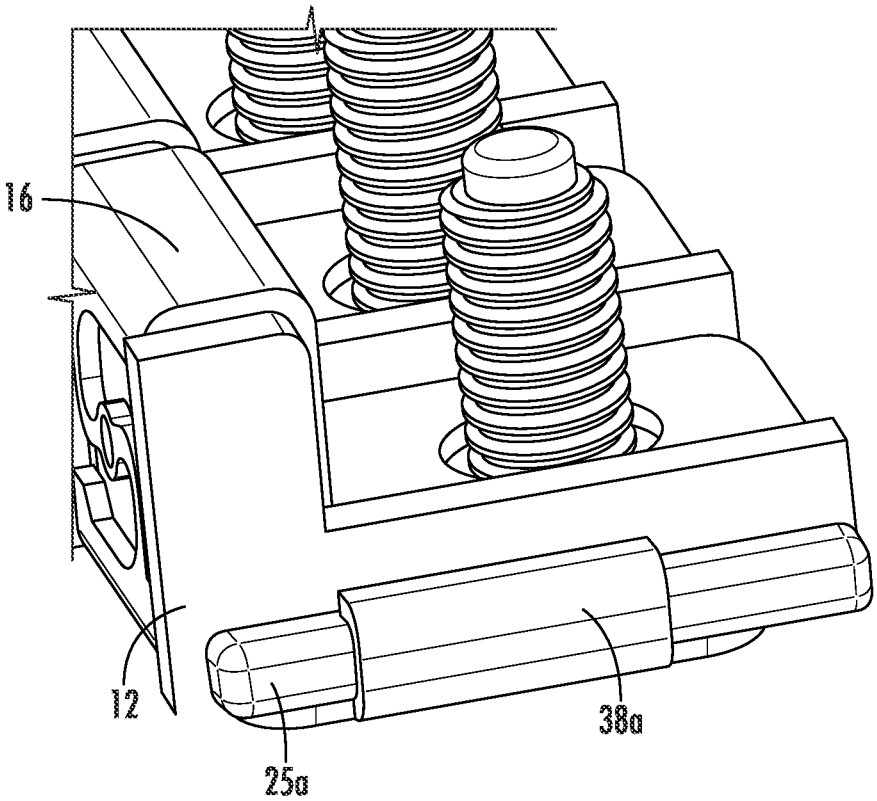
Figure 4E:
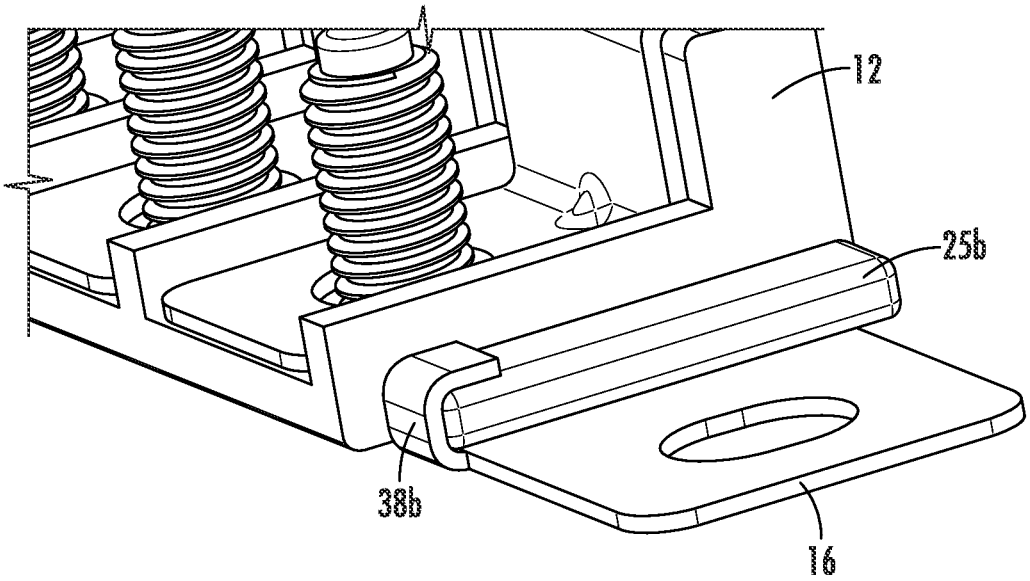

In a fourth assembly step shown in FIGS. 4*d* and 4*e*, the first and second crimping tabs 38*a, b* may be bent about the crimping flanges 25*a, b* of the mounting block 12, respectively. The fuse plate 16 may thus be securely held to the mounting block 12. It will be appreciated that the depicted arrangement and configuration of the crimping tabs 38*a, b* and crimping flanges 25*a, b* is merely exemplary, and that the arrangement, configuration, location, size, and/or shape of one or more of the crimping tabs 38*a, b* and crimping flanges 25*a, b* may be varied without departing from the present disclosure. It will also be appreciated that, in various alternative embodiments of the fuse module 10, it is contemplated that one or more of the crimping tabs 38*a, b* and crimping flanges 25*a, b* may be omitted, and/or that the fuse plate 16 may be secured to the mounting block 12 using any of a variety of mechanical fasteners, adhesives, etc.

Figure 5:
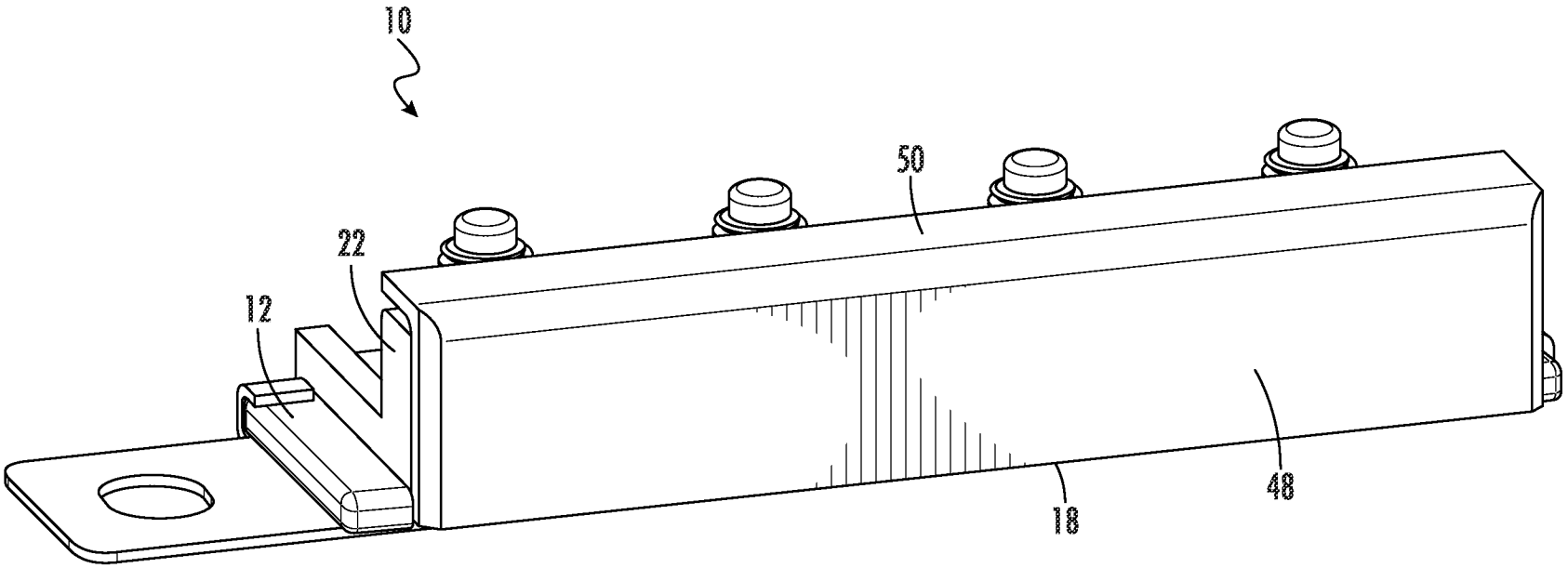
FIG. 5 is rear perspective view illustrating the fuse module shown in FIG. 1.

Referring now to FIG. 5, the cover 18 of the fuse module 10, which may be formed of an electrically insulating material similar to that from which the mounting block 12 is formed, may be an elongated member having a generally L-shaped cross sectional shape defined by a rear wall 48 and a top wall 50. The rear wall 48 may be disposed in flat abutment with the rear wall 22 of the mounting block 12 and may be securely fastened thereto, such as by ultrasonically welding the rear wall 48 to the rear wall ridges 26*a-e* (not within view), for example. The top wall 50 may extend over a top edge of the rear wall 22 of the mounting block 12. The cover 18 may be disposed over the fusible elements 36*a-d* (not within view) for protecting the fusible elements 36*a-d* from ambient particulate as well as for containing electrical arcing in the fusible elements 36*a-d* that may occur during overcurrent conditions.

Figure 6:
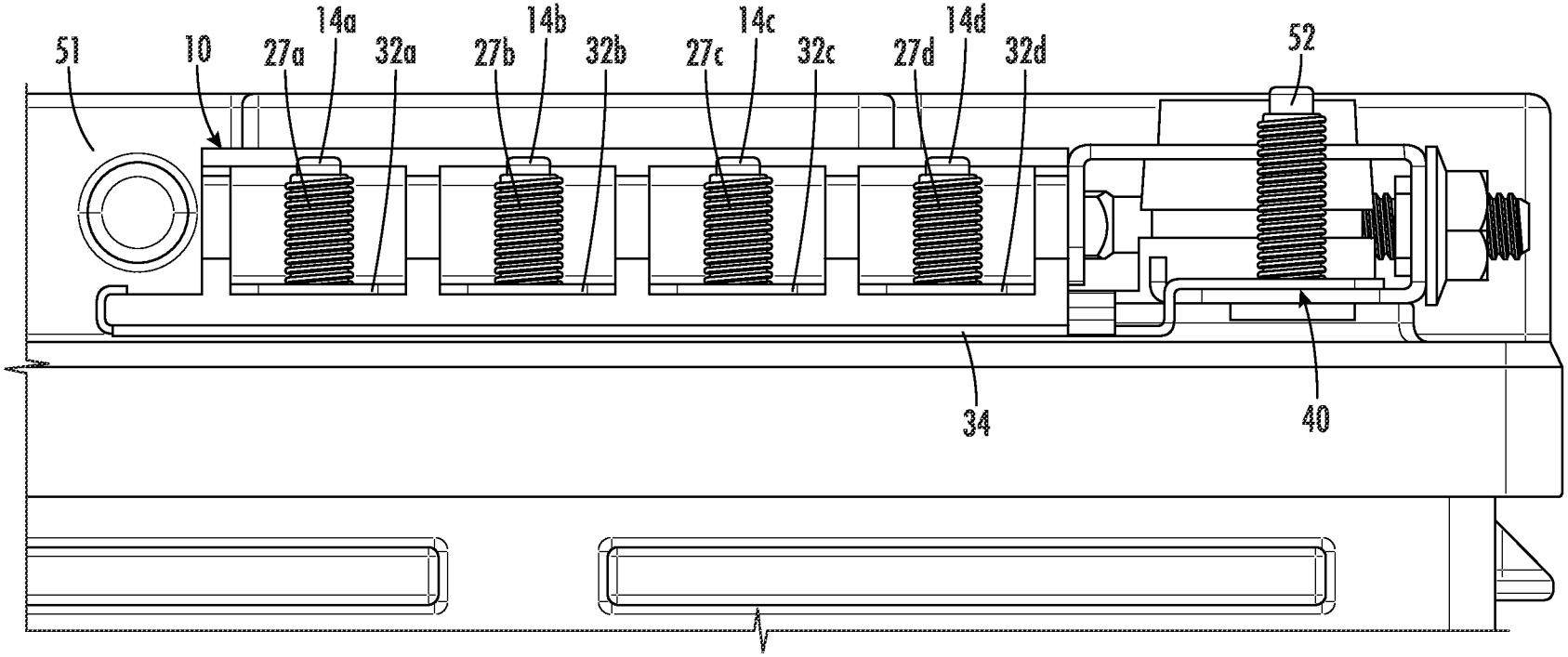
FIG. 6 is a front view illustrating the fuse module shown in FIG. 1 installed on an automobile battery.

Referring to FIG. 6, a front view illustrating the fuse module 10 installed on an automobile battery 51 is shown. The fuse module 10 may be entirely disposed on a top surface of the automobile battery 51 with a positive terminal 52 of the automobile battery 51 extending through the mounting aperture 40 of the bus bar 34. A nut or other fastener (not shown) may be tightened onto the positive terminal 52 and may secure the bus bar 34 to the positive terminal 52 in electrical communication therewith. The terminal posts 14*a-d* may receive ring terminals of conductors (not shown) which may be secured the against the fuse terminals 32*a-d* in electrical communication therewith with nuts (not shown) that may be tightened onto the threaded shafts 27*a-d*. Thus, various electrical systems or components of an automobile may be electrically coupled to the positive terminal 52 of the automobile battery 51 via the fuse terminals 32*a-d*, the fusible elements 36*a-d*, and the bus bar 34, with the fusible elements 36*a-d* providing over-current protection between the automobile battery 51 and such electrical systems or components.

It will be appreciated by those of ordinary skill in the art that the fuse module 10 of the present disclosure provides numerous advantages relative to pre-fuse boxes that are currently available on the market. For example, the entire fuse module 10 can be mounted directly to a positive terminal of an automobile battery in close proximity thereto without any flexible conductors extending therebetween. This provides a significant space and material savings relative to conventional pre-fuse boxes. Additionally, owing to the low profile (i.e., short) form factor of the fuse module 10, the fuse module 10 may be entirely disposed on top of an automobile battery (as shown in FIG. 6) and may extend to a vertical height that is shorter than that of other components within an automobile engine compartment. The fuse module 10 therefore does not extend into the required pedestrian protection zone below a hood of an automobile. For example, as shown in FIG. 6, the fuse module 10 extends to a vertical height that is shorter than that of the positive terminal 52 of the automobile battery 51. Additionally, since the fuse module 10 can be entirely disposed on top of an automobile battery, the fuse module 10 does not require any strain relief features or structures that are typically necessary for the implementation of conventional pre-fuse boxes that hang off of the side of an automobile battery.

Figure 7A:
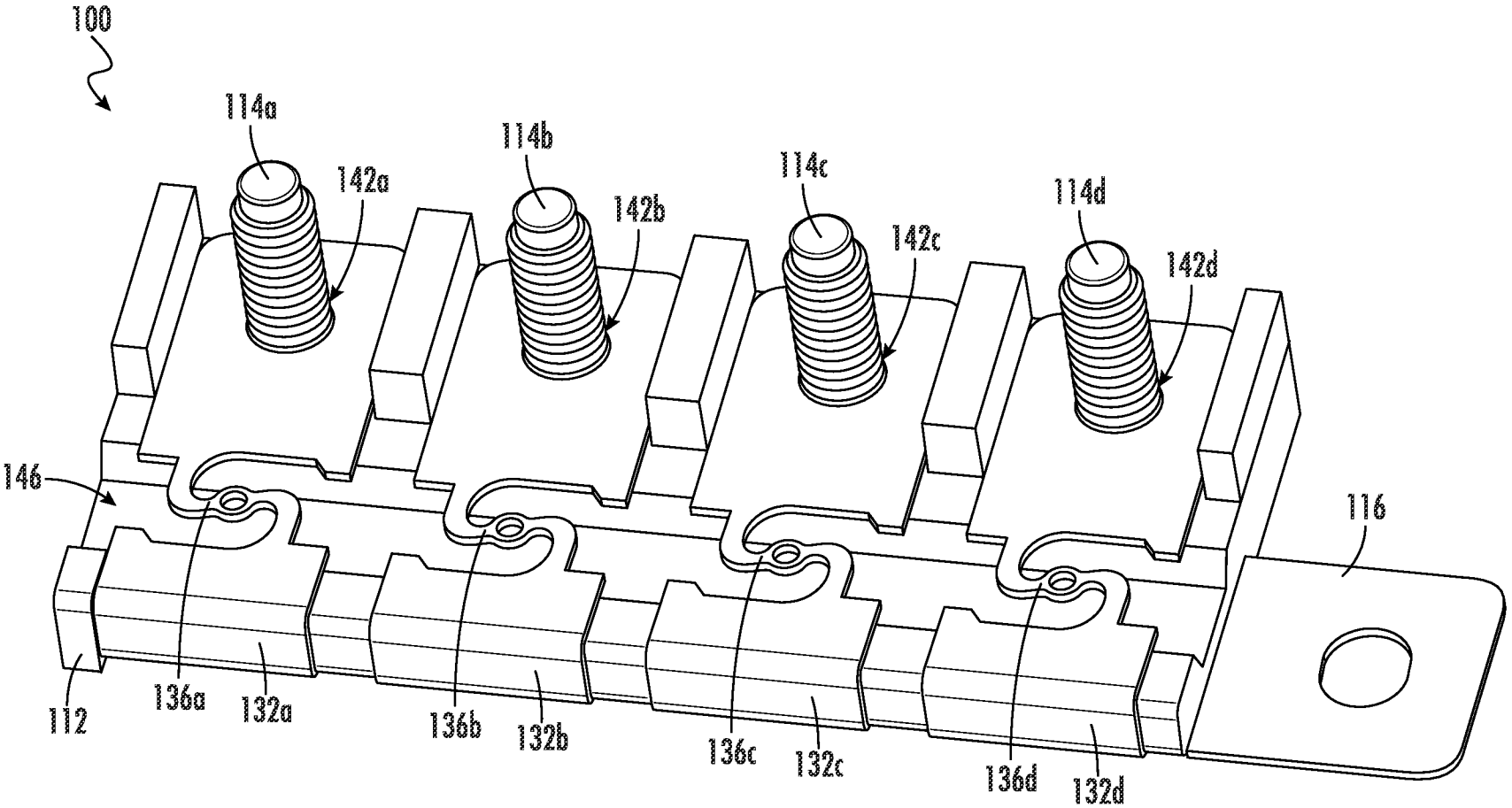
FIGS. 7*a* and 7*b* are perspective views illustrating another embodiment of a fuse module in accordance with the present disclosure.

Referring to FIG. 7*a* a fuse module 100 in accordance with another exemplary embodiment of the present disclosure is shown. The fuse module 100 may be substantially similar to the fuse module 10 described above, with a fuse plate 116 wrapped about a mounting block 112 and with terminal posts 114*a-d* extending through respective mounting apertures 142*a-d* in fuse terminals 132*a-d* of the fuse plate 116. The fuse module 100 differs from the above described fuse module 10 in that the mounting block 112 does not have a rear wall (e.g., the rear wall 22 shown in FIG. 1), and that the fusible elements 136*a-d* extend over a trough or recess 146 in the top surface of the mounting block 112.

Figure 7B:
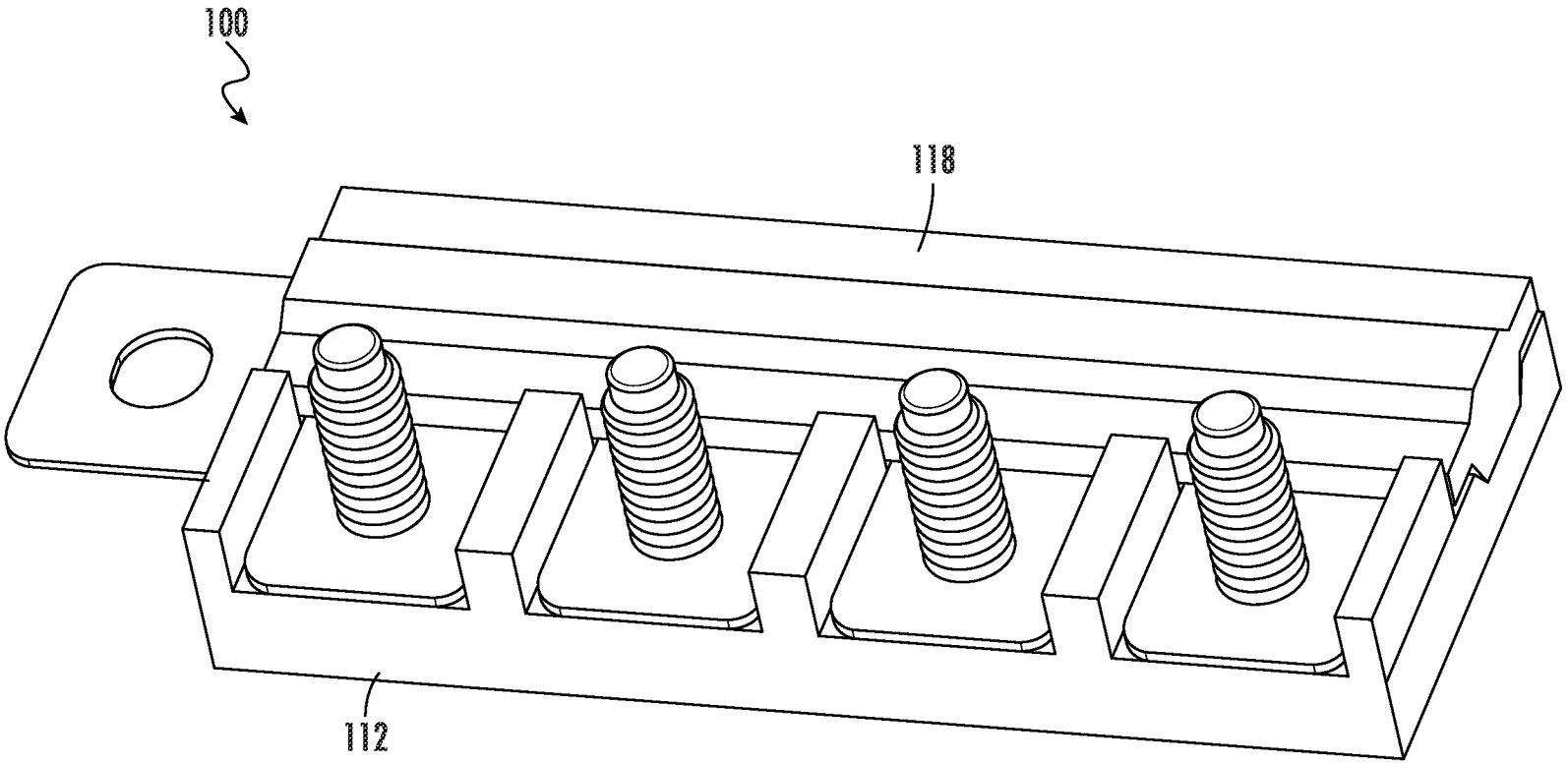

Additionally, the mounting block 112 does not have crimping tabs, and the fuse plate 116 does not have crimping flanges (e.g., like the first and second crimping tabs 38*a, b* and first and second crimping flanges 25*a, b* shown in FIGS. 4*d* and 4*e*) for securing the fuse plate 116 to the mounting block 112. Instead, as shown in FIG. 7*b*, the fuse plate 116 is secured to the mounting block 112 by a cover 118 that extends over the fusible elements 136*a-d* and the recess 146 (not within view) and that is coupled to the mounting block 112 (e.g., via ultrasonic welding, heat staking, adhesives, etc.).

Figure 8A:
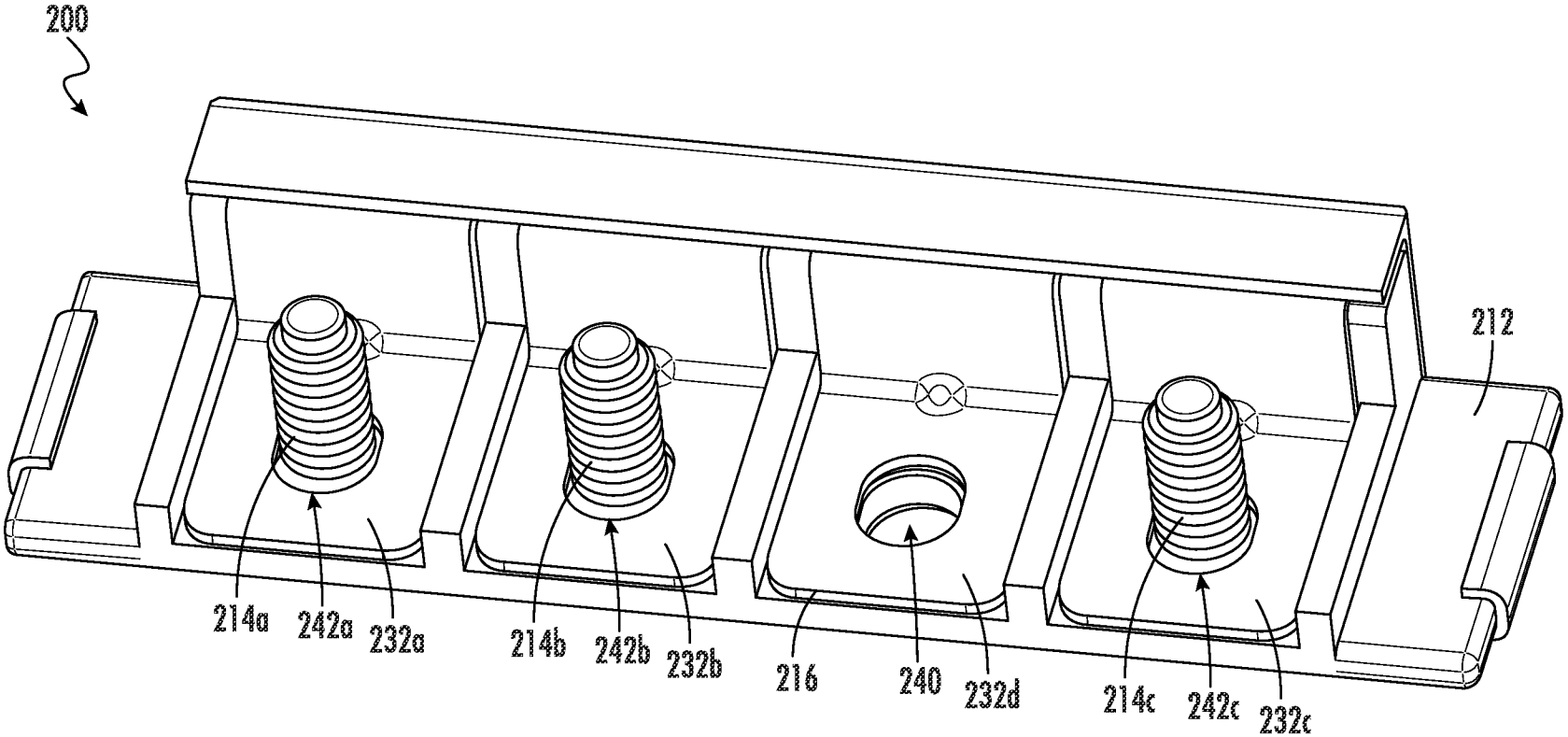
FIG. 8*a*-8*e* are perspective and cross-sectional views illustrating further alternative embodiments of the fuse module shown in FIG. 1.
Figure 8B:
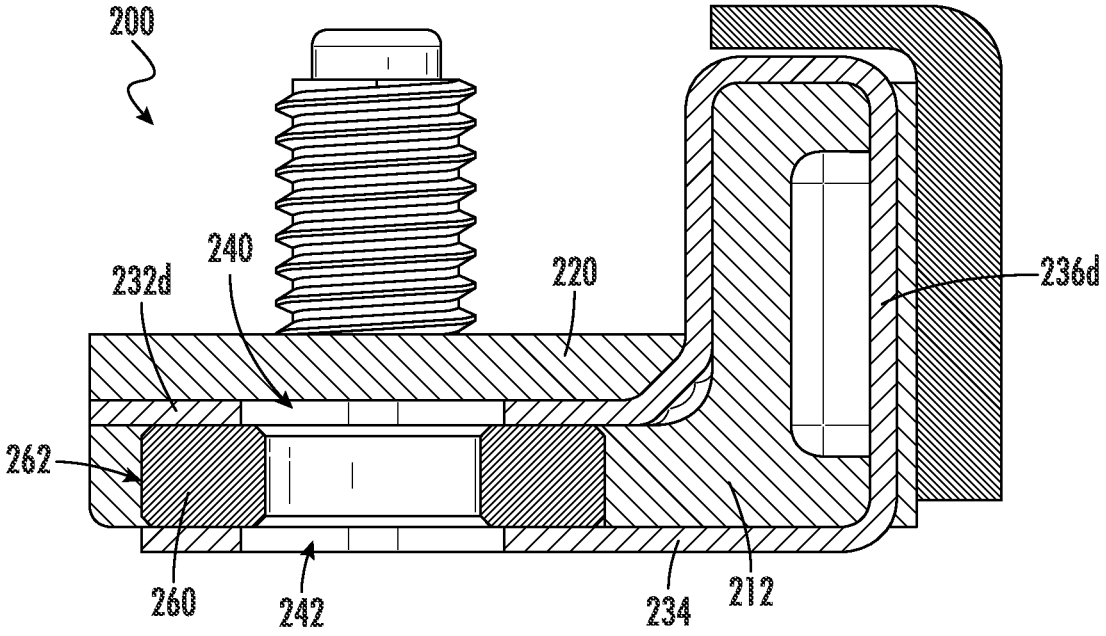

Referring to FIG. 8*a*, a fuse module 200 in accordance with another exemplary embodiment of the present disclosure is shown. The fuse module 200 may be substantially similar to the fuse module 10 described above, with a fuse plate 216 wrapped about a mounting block 212 and with terminal posts 214*a-c* extending through respective mounting apertures 242*a-c* in fuse terminals 232*a-c* of the fuse plate 216. The fuse module 200 differs from the above described fuse module 10 in that the fuse plate 216 does not have a mounting aperture in a longitudinal end of a bus bar thereof (e.g., like mounting aperture 40 of the bus bar 34 shown in FIG. 1). Rather, the fuse plate 216 may include an input terminal 232*d* that is substantially similar to the fuse terminals 232*a-c* except that the input terminal 232*d* has, instead of a terminal post extending therefrom, a mounting aperture 240 formed therethrough, the mounting aperture 240 being aligned with a mounting aperture 242 formed in the bus bar 234 of the fuse plate 216 (see FIG. 8*b*). Referring to the cross-sectional view of the input terminal 232*d* and surrounding components of the fuse module 200 shown FIG. 8*b*, an electrically conductive, tubular sleeve 260 may be disposed within a pass-through aperture 262 in the base 220 of the mounting block 212 and may be sandwiched between the input terminal 232*d* and the bus bar 234. The tubular sleeve 260 may thus provide an electrically conductive pathway between the input terminal 232*d* and the bus bar 234. In an alternative embodiment of the fuse module 200, the tubular sleeve 260 may be formed of an electrically insulating material (e.g., plastic, thermoset, etc.), and may thus force electrical current to flow through corresponding fusible element 236*d* and prevent electrical current from circumventing the fusible element 236*d* and flowing directly between the bus bar 234 and the input terminal 232*d*.

Figure 8C:
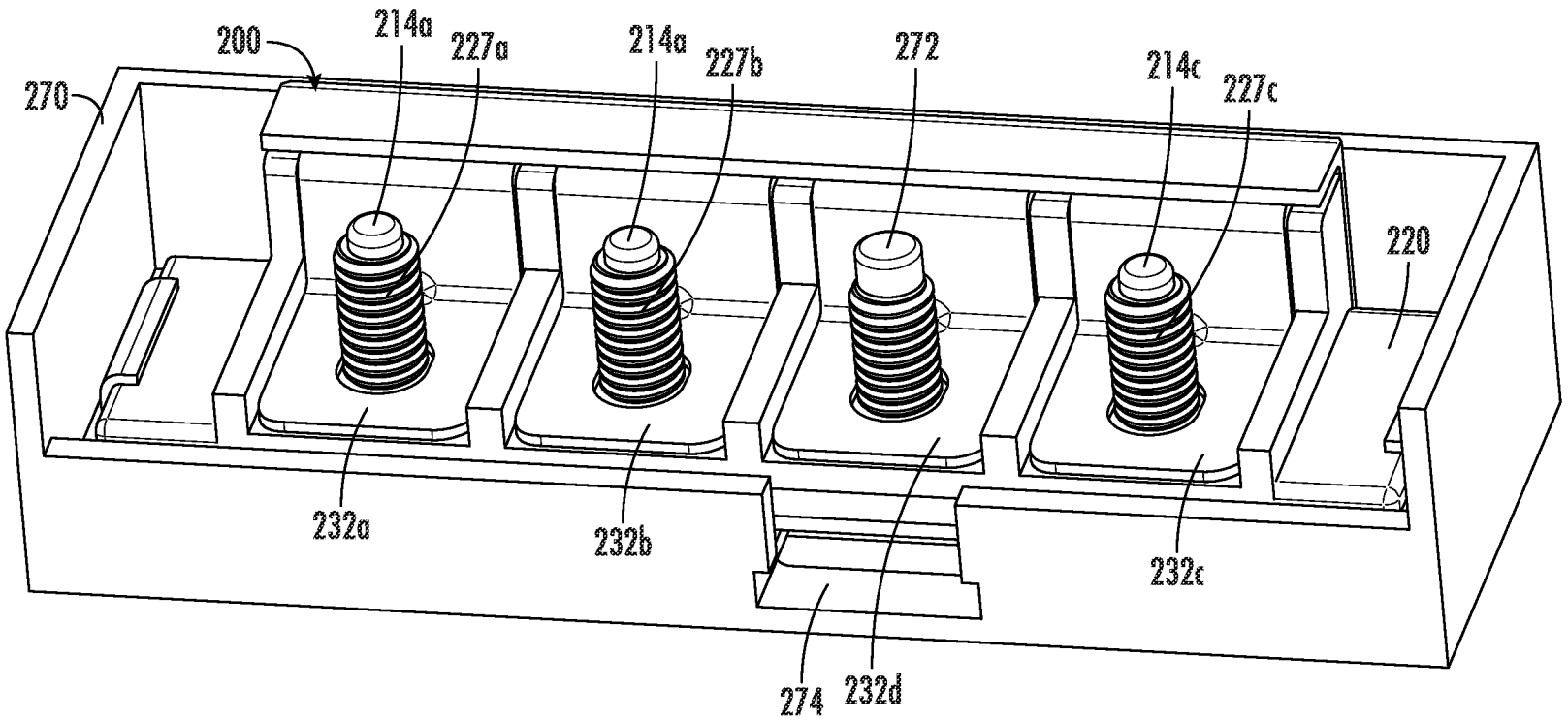

Referring to the exemplary implementation of the fuse module 200 illustrated in FIG. 8*c*, the fuse module 200 may be disposed within an electrically insulating cradle 270 having a pass-through bolt 272 rigidly affixed to, and extending vertically from, a floor 274 thereof. The pass-through bolt 272 may extend through the mounting aperture 242 in the bus bar 234 (see FIG. 8*b*), the pass-through aperture 262 in the base 220 (see FIG. 8*b*), and the mounting aperture 240 in the input terminal 232*d*. The pass-through bolt 272 may receive a ring terminal of conductor extending from a source of electrical power (not shown), and the ring terminal may be secured the against the input terminal 232*d* in electrical communication therewith with a nut (not shown) that may be tightened onto the pass-through bolt 272. Additionally, the terminal posts 214*a-c* may receive ring terminals of conductors extending from electrical components that are to be protected (not shown), and the ring terminals may be secured the against the fuse terminals 232*a-c* in electrical communication therewith with nuts (not shown) that may be tightened onto the threaded shafts 227*a-c*. Electrical current may flow from the input terminal 232*d*, through the tubular sleeve 260, to the bus bar 234, and may thus be distributed to the fuse terminals 232*a-c* via respective fusible elements (not within view, but substantially identical to the fusible elements 36*a-d* described above and shown in FIG. 3, for example). Thus, various electrical systems or components may be electrically coupled to a source of electrical power via the fuse terminals 232*a-c*, respective fusible elements (not within view), the bus bar 234, and the input terminal 232*d*, with the fusible elements providing over-current protection between the source of electrical power and such electrical systems or components.

Figure 8D:
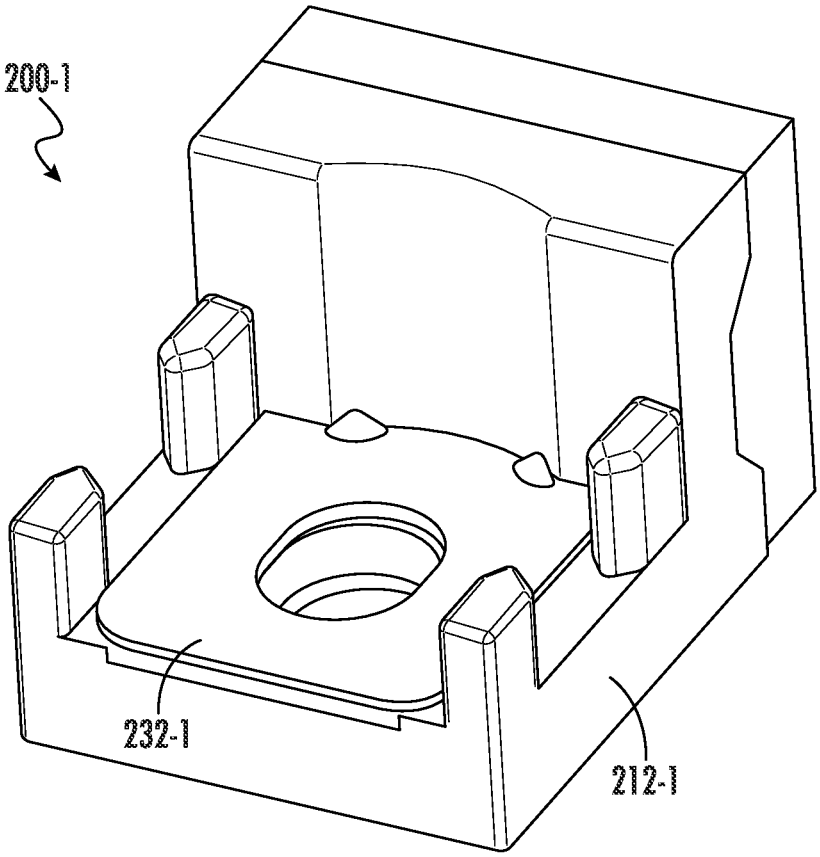
Figure 8E:
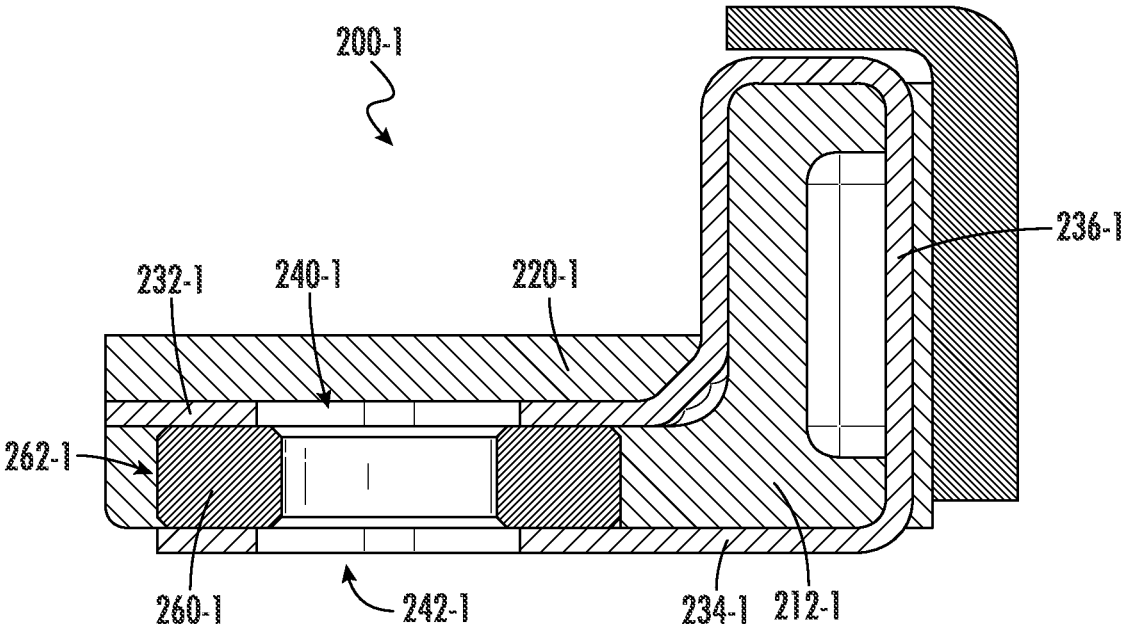
Figure 9A:
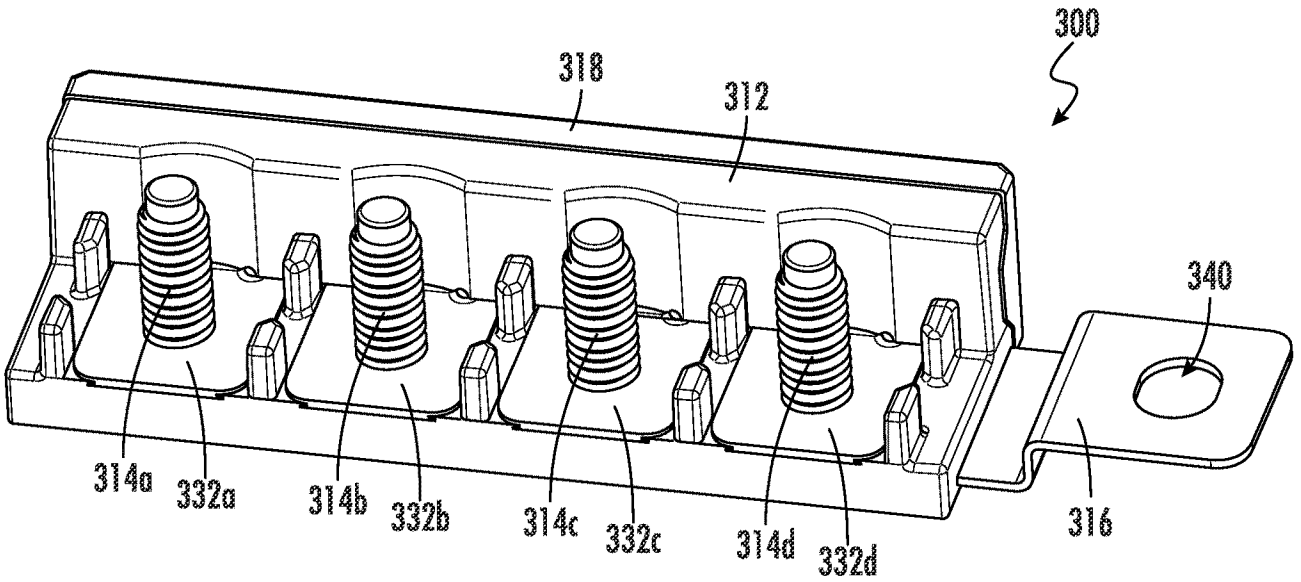
FIGS. 9*a*-9*d* are a series of perspective views illustrating another embodiment of a fuse module in accordance with the present disclosure.
Figure 9B:
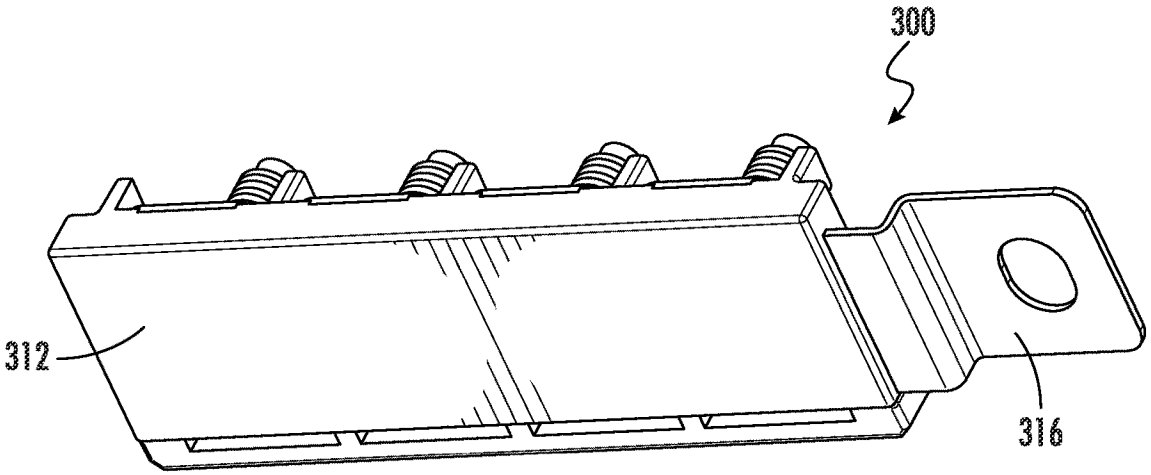
Figure 9C:
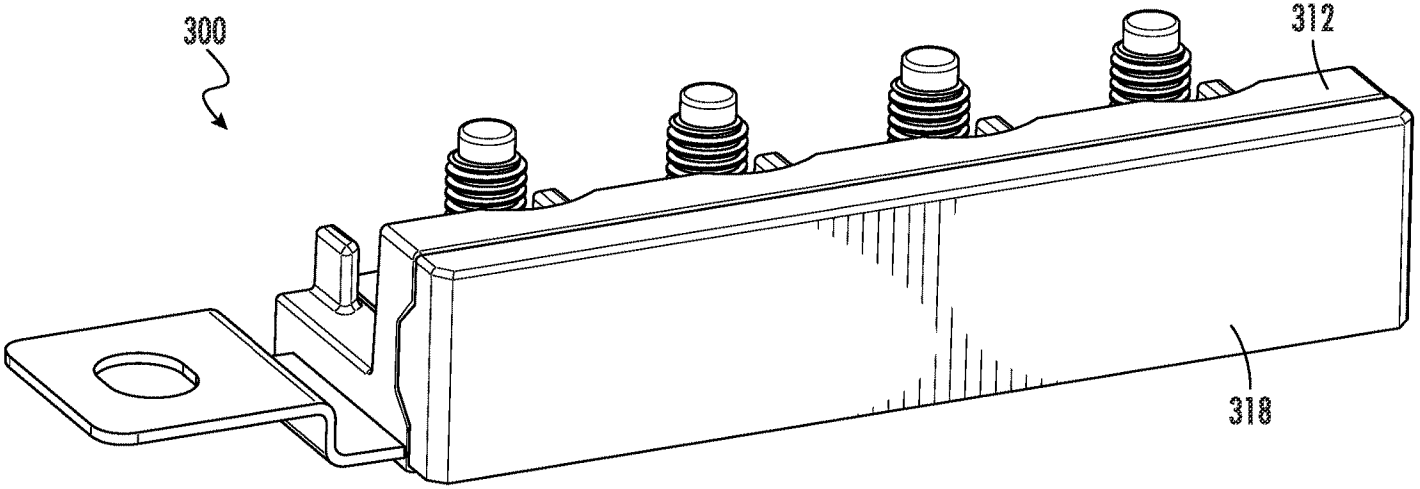
Figure 9D:
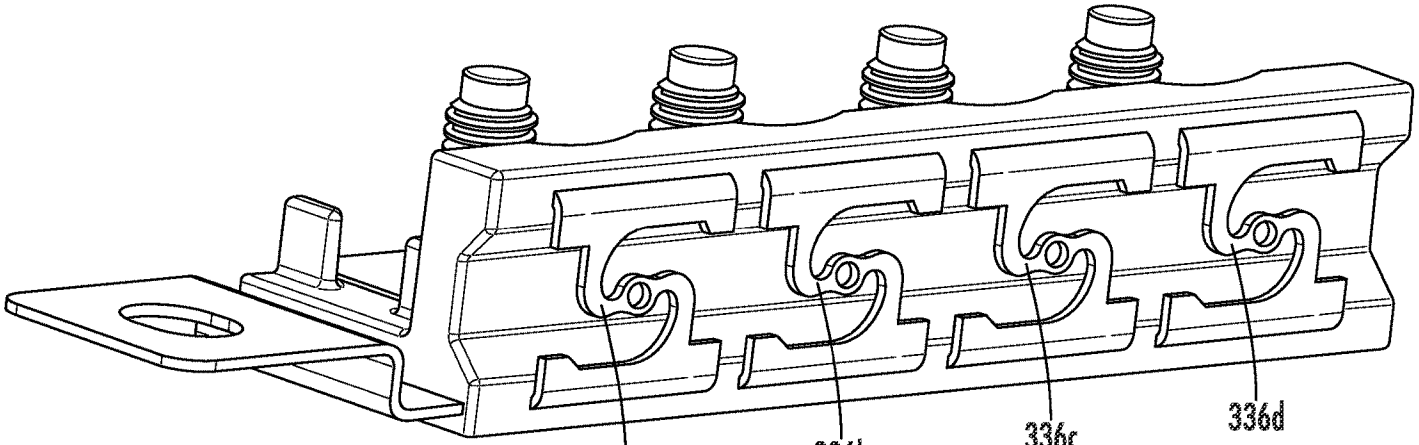

Referring to FIG. 8*d*, an alternative embodiment of the fuse module 200 is shown. This alternative embodiment, referred to hereinafter as "fuse module 200-1," may be similar to the fuse module 200 described above but may include only a single fuse terminal 232-1. The fuse terminal 232-1 may be substantially similar to the input terminal 232*d* described above, having a mounting aperture 240-1 formed therethrough, the mounting aperture 240-1 being aligned with a mounting aperture 242-1 formed in the bus bar 234 of the fuse plate 216-1 (see FIG. 8*e*). Referring to the cross-sectional view of the fuse module 200-1 shown FIG. 8*e*, an electrically insulating tubular sleeve 260-1 may be disposed within a pass-through aperture 262-1 in the base 220-1 of the mounting block 212-1 and may be sandwiched between the fuse terminal 232-1 and the bus bar 234-1. The tubular sleeve 260-1 may force electrical current to flow through the fusible element 236-1 and prevent electrical current from circumventing the fusible element 236-1 and flowing directly between the bus bar 234-1 and the fuse terminal 232-1. Thus, an electrical system or component may be electrically coupled to a source of electrical power via the fuse terminal 232-1, the respective fusible element 236-1, the bus bar 234, and the fuse terminal 232-1, with the fusible element 236-1 providing over-current protection between the source of electrical power and such electrical system or component.

Referring to FIGS. 9*a*-9*d*, a fuse module 300 in accordance with another exemplary embodiment of the present disclosure is shown. The fuse module 300 may be substantially similar to the fuse module 10 described above, and may include a mounting block 312, a plurality of terminal posts 314*a-d*, a fuse plate 316 having a mounting aperture 340 in a longitudinal end thereof, and a cover 318. However, instead of the fuse plate 316 being wrapped or folded about the mounting block 312 as in the fuse module 10, the mounting block 312 may be molded onto the pre-folded fuse plate 316 (e.g., via insert molding), such that portions of the fuse plate 316 are embedded within the mounting block 312. The fuse terminals 332*a-d* and the fusible elements 336*a-d* of the fuse plate 316, which may be substantially similar to the fuse terminals 32*a-d* and fusible elements 36*a-d* of the fuse plate 16 described above, may be left exposed. The cover 318 (omitted in FIG. 9*d*) may be fastened to the mounting block 312 over the fusible elements 336*a-d* for protecting the fusible elements 336*a-d* from ambient particulate as well as for containing electrical arcing in the fusible elements 336*a-d* that may occur during overcurrent conditions.

Figure 10A:
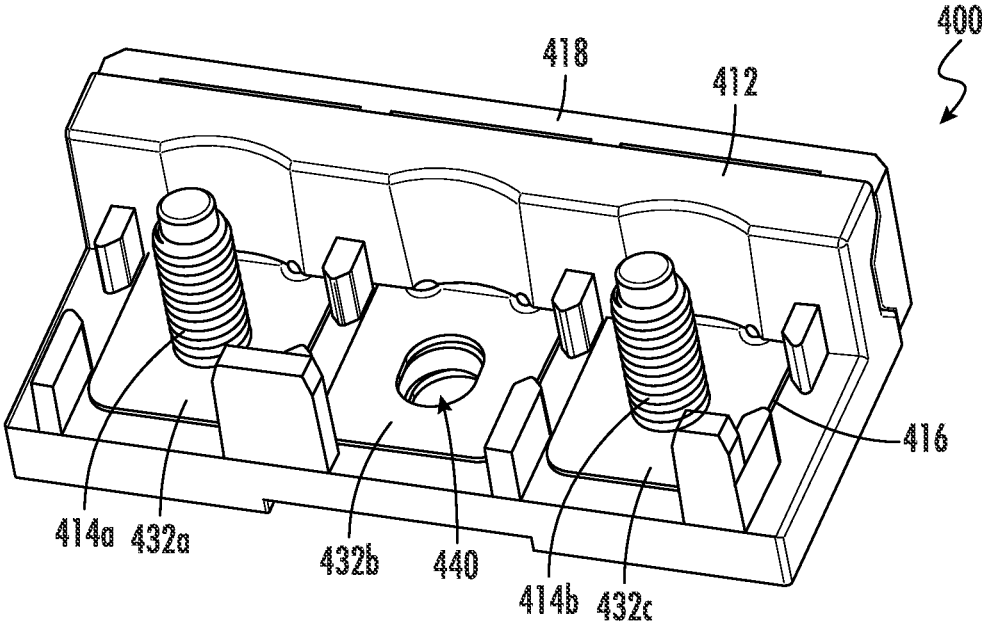
FIGS. 10*a*-10*e* are a series of perspective and cross sectional views illustrating another embodiment of a fuse module in accordance with the present disclosure.
Figure 10B:
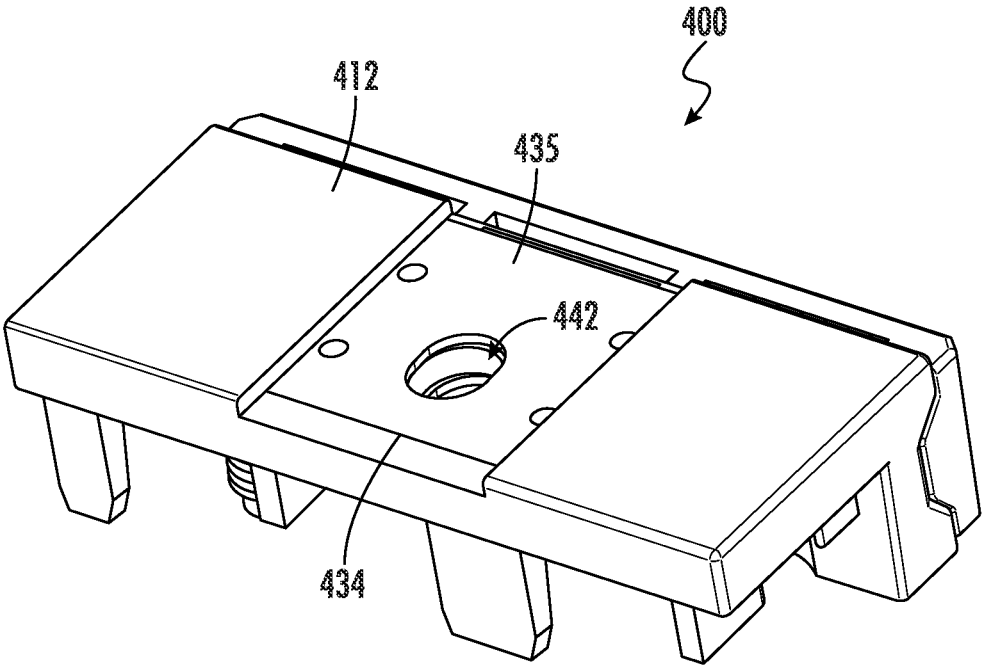
Figure 10C:
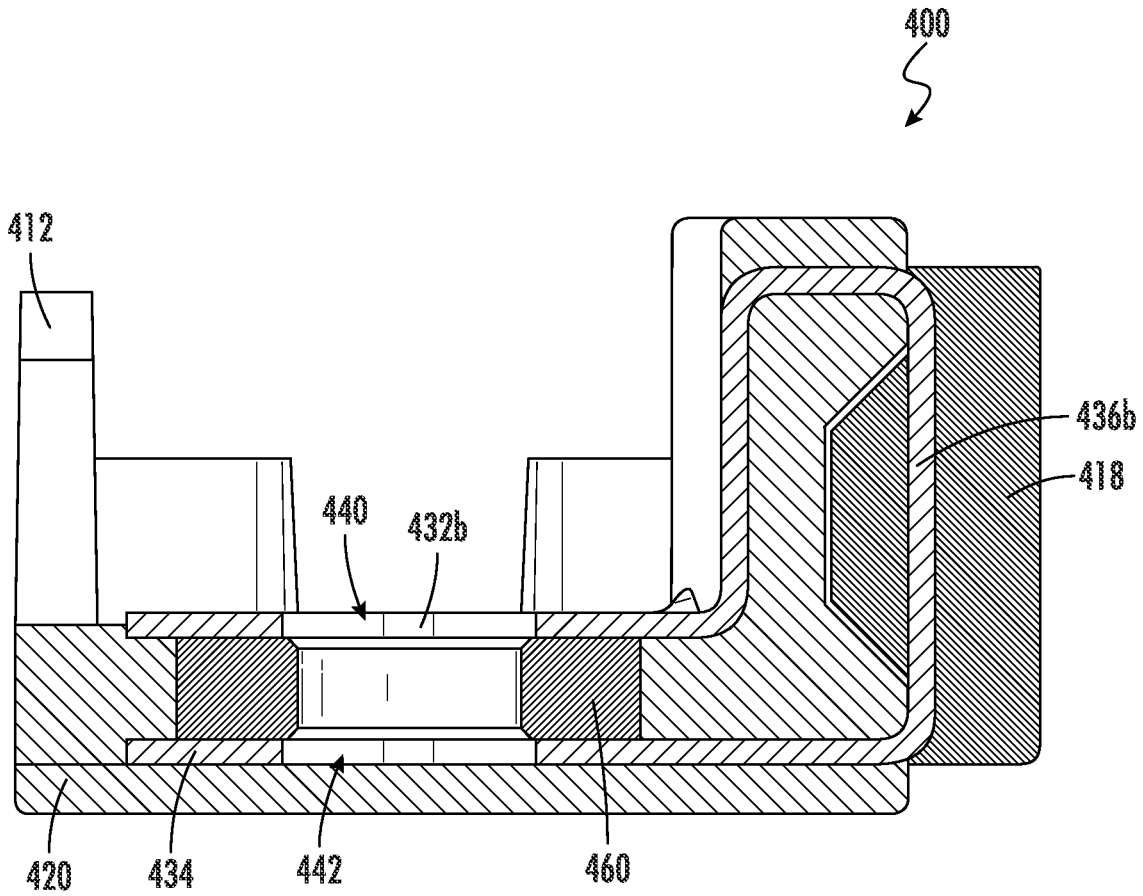

Referring to FIGS. 10*a*-10*c*, a fuse module 400 in accordance with another exemplary embodiment of the present disclosure is shown. The fuse module 400 may be substantially similar to the fuse module 300 described above, and may include a mounting block 412, a plurality of terminal posts 414*a*, 414*b*, a fuse plate 416, and a cover 418, wherein the mounting block 412 may be molded onto the fuse plate 416 (e.g., via insert molding), such that portions of the fuse plate 416 are embedded within the mounting block 412. The fuse module 400 differs from the above described fuse module 300 in that the fuse plate 416 does not have a mounting aperture in a longitudinal end of a bus bar thereof (e.g., like mounting aperture 340 of the bus bar 334 shown in FIG. 9*a*). Rather, the fuse plate 416 may include a fuse terminal 432*b* that is substantially similar to the fuse terminals 432*a*, 432*c*, except that the fuse terminal 432*b* has, instead of a terminal post extending therefrom, a mounting aperture 440 formed therethrough, the mounting aperture 440 being aligned with a mounting aperture 442 formed in the bus bar 434 of the fuse plate 416 (see FIG. 10*b*). Additionally, a portion 435 of the underside of the bus bar 434 surrounding the mounting aperture 442 may be exposed (i.e., not covered by the mounting block 412).

Referring to the cross sectional view of the of the fuse terminal 432*b* and surrounding components of the fuse module 400 shown in FIG. 10*c*, an electrically insulating, tubular sleeve 460 may be disposed within (e.g., may be molded within) the base 420 of the mounting block 412 and may be sandwiched between the fuse terminal 432*b* and the bus bar 434. The tubular sleeve 460 may thus force electrical current to flow through the fusible element 436*b* and prevent electrical current from circumventing the fusible element 436*b* and flowing directly between the bus bar 434 and the fuse terminal 432*b*. The tubular sleeve 460 may be formed of any suitable, electrically insulating material, including, but not limited to, plastic, ceramic, thermoset, etc. In an alternative embodiment of the fuse module 400, the tubular sleeve 460 may be formed of an electrically conductive material, thus providing a shunt between the fuse terminal

432*b* and the bus bar 434 for allowing electrical current to flow directly therebetween to circumvent the fusible element 436*b*.

Figure 10D:
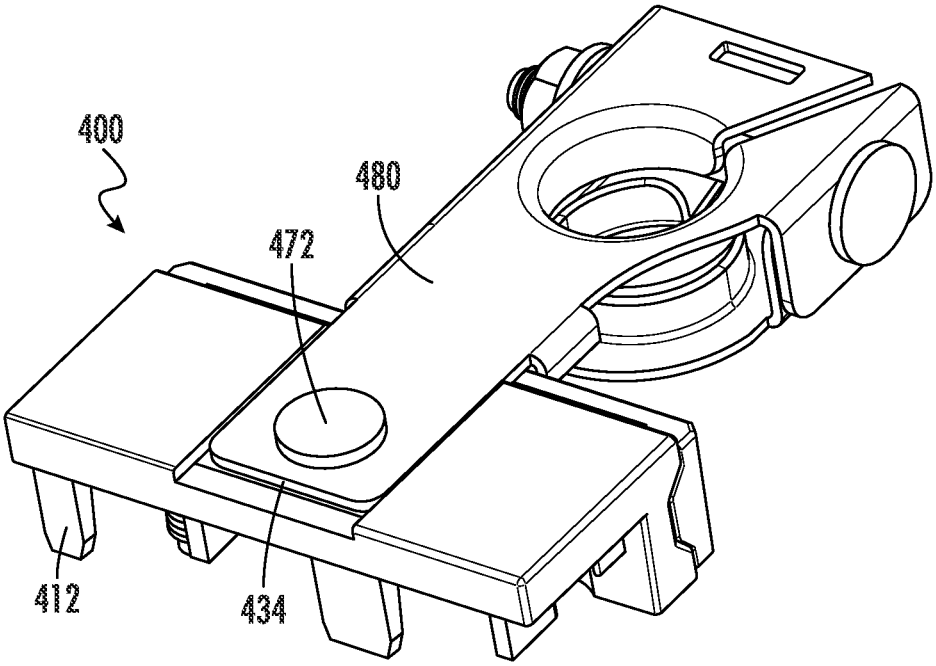
Figure 10E:
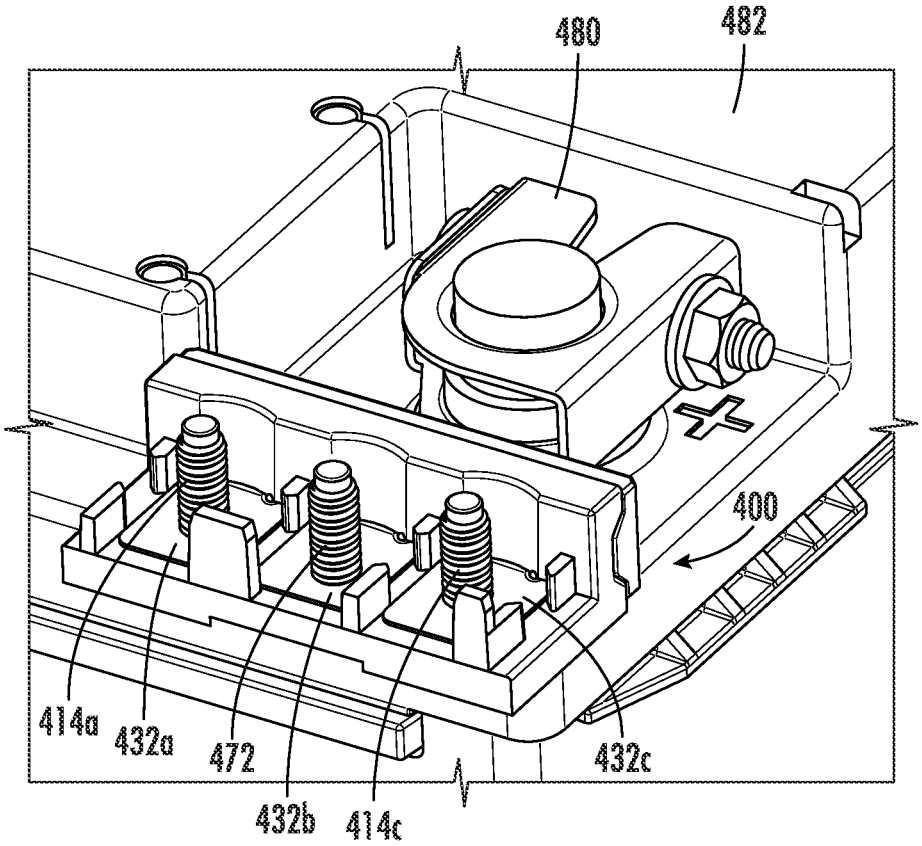

Referring to the exemplary implementation of the fuse module 400 illustrated in FIGS. 10*d* and 10*e*, an electrically conductive battery clamp 480 may be coupled to the exposed portion 435 of the bus bar 434, with a pass-through bolt 472 extending from the battery clamp 480 through the mounting aperture 442 in the bus bar 434, the tubular sleeve 460 (see FIG. 10*c*), and the mounting aperture 440 in the fuse terminal 432*b*. The pass-through bolt 472 may receive a ring terminal of a conductor extending from an electrical component to be protected (not shown), and the ring terminal may be secured the against the fuse terminal 432*b* in electrical communication therewith with a nut (not shown) that may be tightened onto the pass-through bolt 472. The pass-through bolt 472 may be formed on an electrically insulating material and/or may otherwise be electrically isolated from the battery clamp 480 to ensure that current flows through the fusible element 436*b* instead of shunting directly from the bus bar 434, through the pass-through bolt 472, to the fuse terminal 432*b*. Additionally, the terminal posts 414*a*, 414*b* may receive ring terminals of conductors extending from electrical components that are to be protected (not shown), and the ring terminals may be secured the against the fuse terminals 432*a*, 432*c* in electrical communication therewith with nuts (not shown) that may be tightened onto the terminal posts 414*a*, 414*b*. Thus, the battery clamp 480 may be coupled to a positive terminal of a battery 482 as shown in FIG. 10*e*, and electrical current may flow from the battery 482, through the battery clamp 480 to the bus bar 434, and may thus be distributed to the fuse terminals 432*a-c* via respective fusible elements (now within view, but substantially identical to the fusible elements 36*a-d* described above and shown in FIG. 3, for example). Thus, various electrical systems or components may be electrically coupled to the battery 482 via the fuse terminals 432*a-c*, respective fusible elements (not within view), the bus bar 434, and the battery clamp 480, with the fusible elements providing over-current protection between the battery 482 and such electrical systems or components.

Figure 11A:
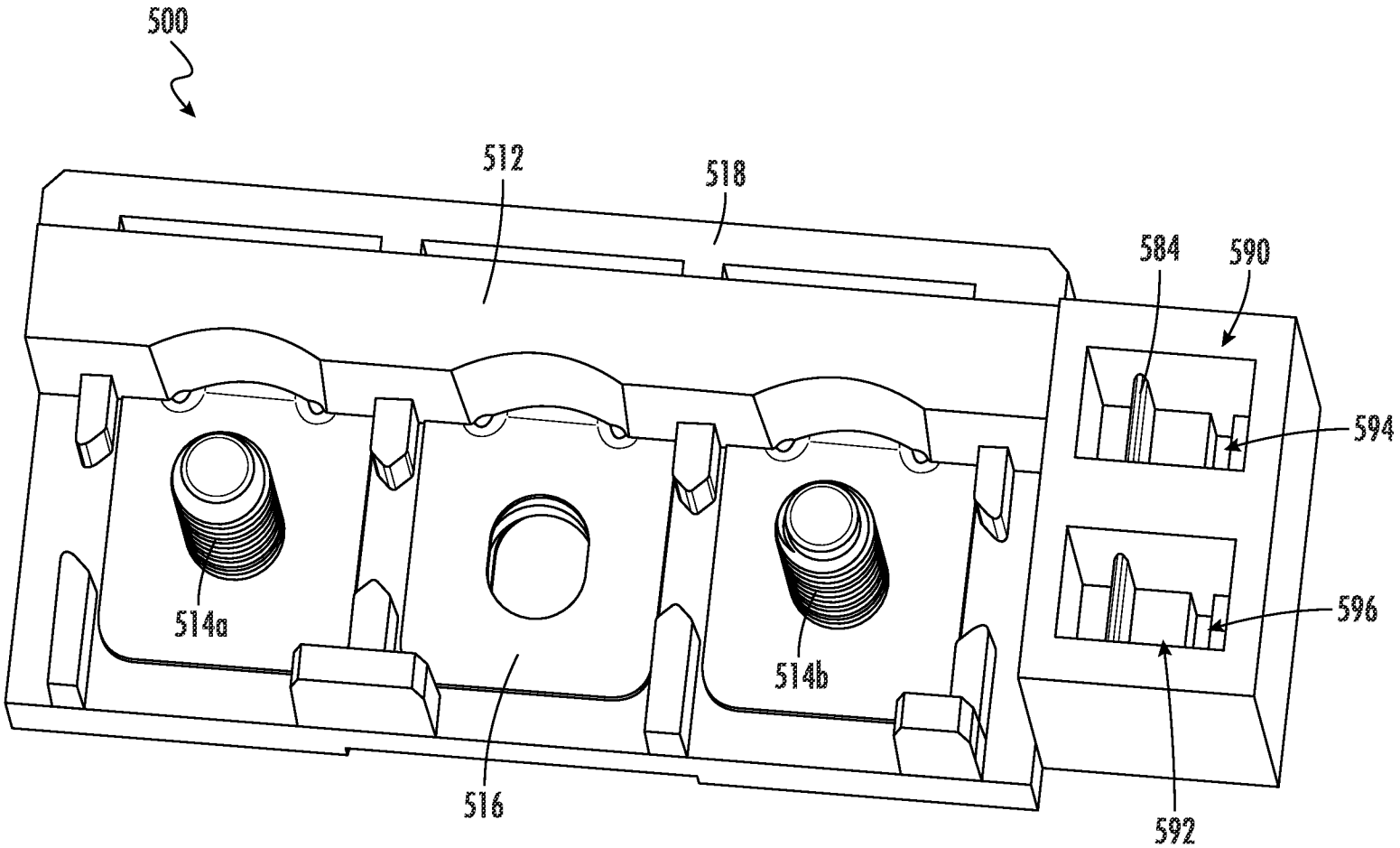
FIGS. 11*a*-11*c* are a series of perspective views illustrating another embodiment of a fuse module in accordance with the present disclosure.
Figure 11B:
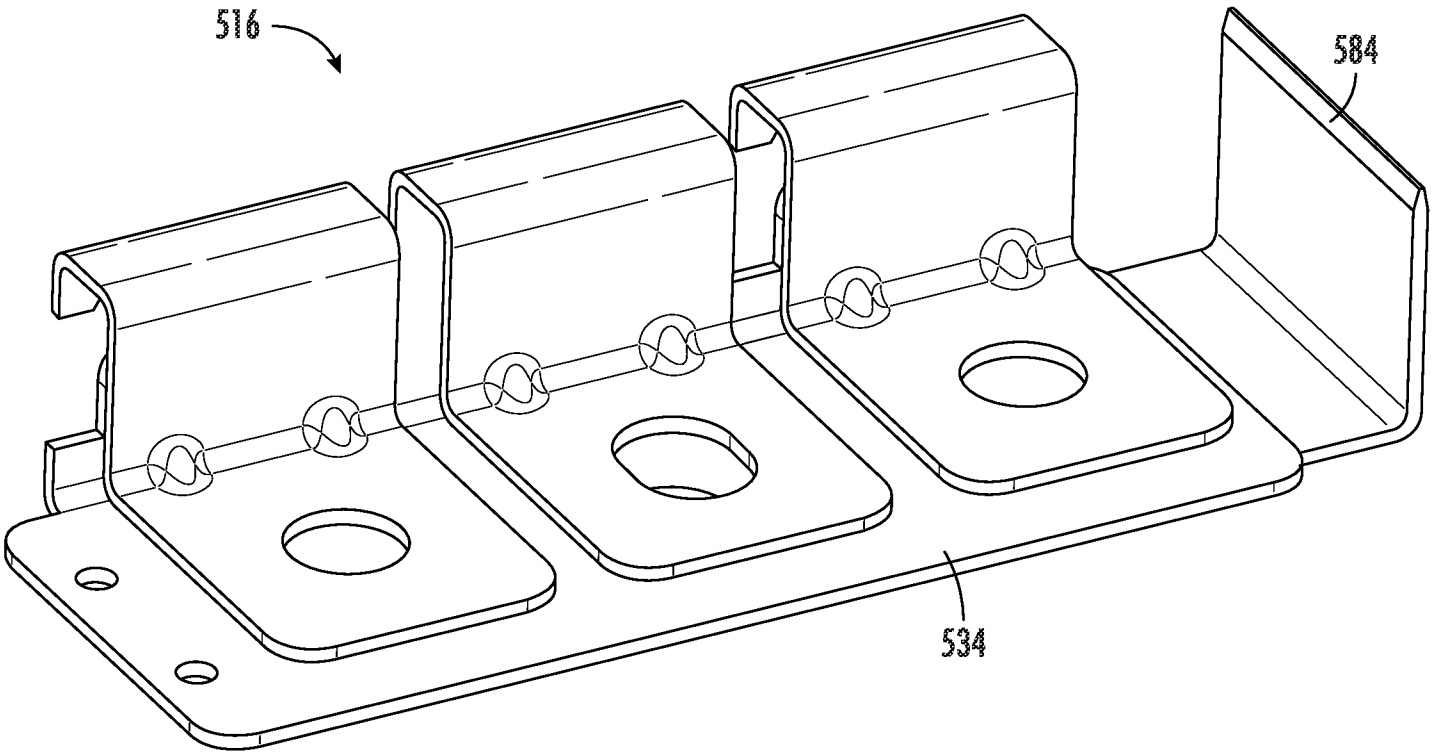

Referring to FIG. 11*a*, a fuse module 500 in accordance with another exemplary embodiment of the present disclosure is shown. The fuse module 500 may be substantially similar to the fuse module 400 described above, and may include a mounting block 512, a plurality of terminal posts 514*a*, 514*b*, a fuse plate 516, and a cover 518, wherein the mounting block 512 may be molded onto the fuse plate 516 (e.g., via insert molding), such that portions of the fuse plate 516 are embedded within the mounting block 512. The fuse module 500 differs from the above described fuse module 400 in that the fuse plate 516, which is shown in isolation in FIG. 11*b*, may additionally include a bus extension 584 that is contiguous with the bus bar 534. The bus extension 584 may be formed of a substantially planar sheet of material (e.g., a contiguous extension of the fuse plate 516), and may be bent or folded to define a substantially right angle with respect to the bus bar 534 (this is not critical).

Figure 11C:
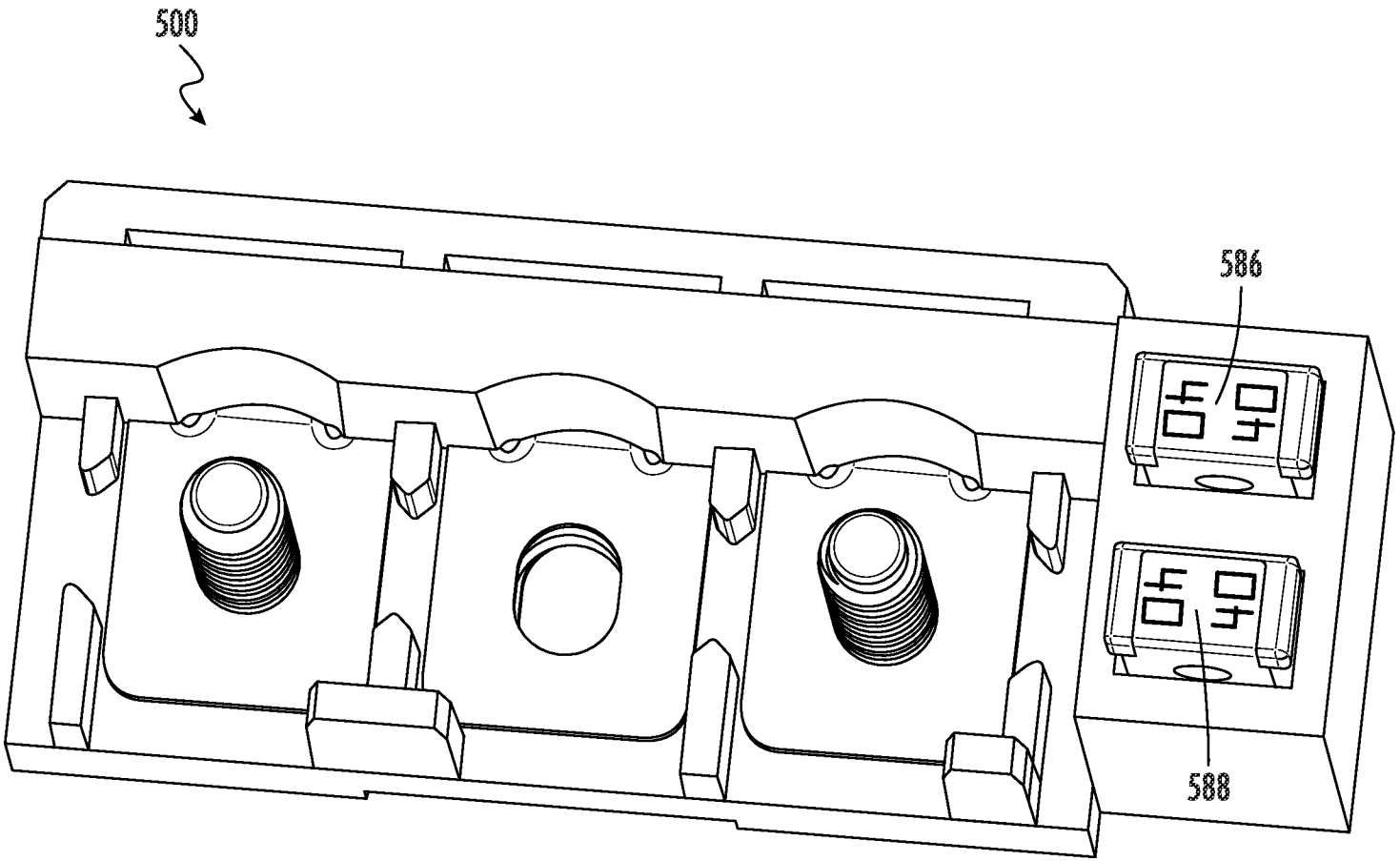

The bus extension 584 may facilitate the connection of fuses having low-medium amperage ratings (e.g., 5-60 amps) to the fuse module 500. For example, the top edge of the bus extension 584 may facilitate connection to slotted cartridge fuses 586, 588 (see FIG. 11*c*) that may be seated within respective recesses 590, 592 (see FIG. 11*a*) formed in the top of the mounting block 512 and connected to respective electrical conductors (not shown) that extend through apertures 594, 596 in bottom of the mounting block 512.

Figure 12A:
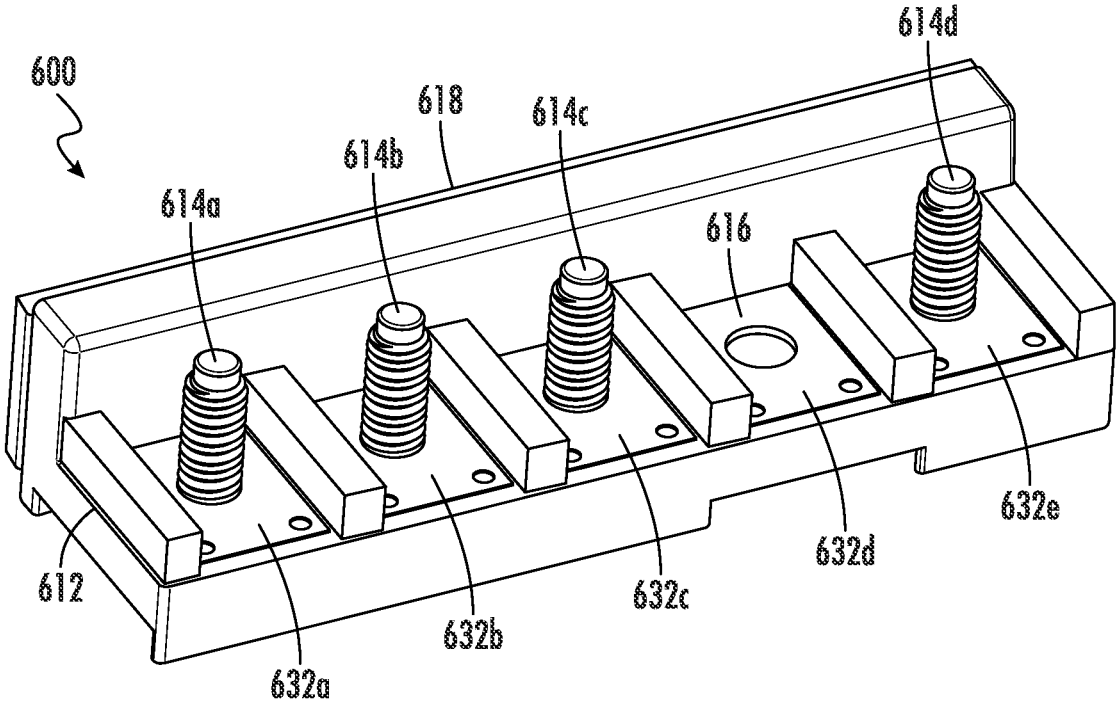
FIGS. 12*a* and 12*b* are a series of perspective views illustrating another embodiment of a fuse module in accordance with the present disclosure.
Figure 12B:
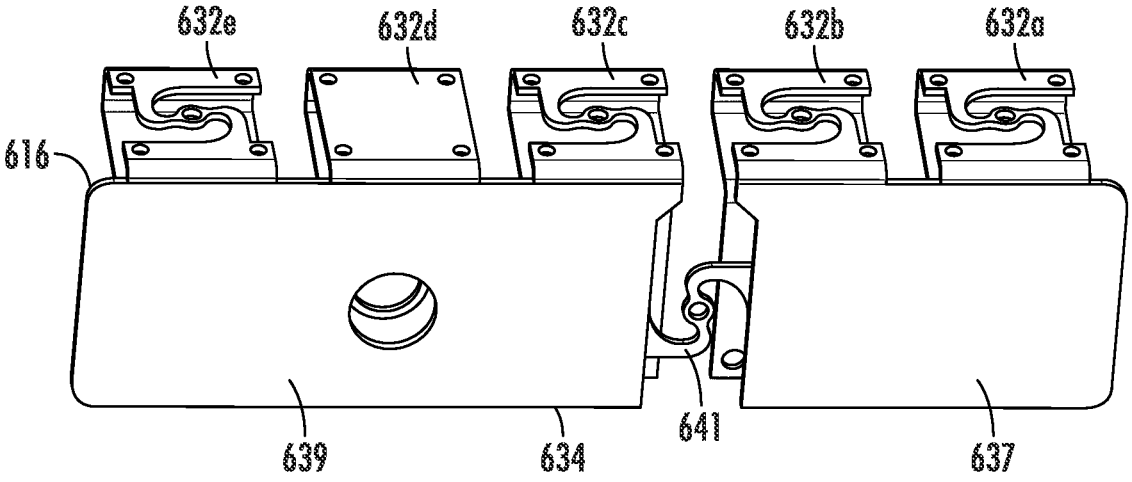

Referring to FIG. 12*a*, a fuse module 600 in accordance with another exemplary embodiment of the present disclosure is shown. The fuse module 600 may be similar to the fuse module 400 described above (shown in FIGS. 10*a-c*), and may include a mounting block 612, a plurality of terminal posts 614*a*, 614*b*, 614*c*, 614*d*, a fuse plate 616, and a cover 618, wherein the mounting block 612 may be molded onto the fuse plate 616 (e.g., via insert molding), such that portions of the fuse plate 616 are embedded within the mounting block 612. The fuse module 600 differs from the above described fuse module 400 in that the bus bar 634 of the fuse plate 616, which is shown in isolation in FIG. 12*b*, may include a first portion 637 and a second portion 639 that are connected to one another by a fusible element 641 that provides overcurrent protection between the first portion and the second portion. The fuse plate 616 may include fuse terminals 632*a*, 632*b*, 632*c*, 632*d*, 632*e*, wherein the fuse terminals 632*a*, 632*b* are connected to the first portion 637 of the bus bar 634 and the fuse terminals 632*c-e* are connected to the second portion 639 of the bus bar 634.

During normal operation of the fuse module 600, electrical current may be supplied to the bus bar 634 (e.g., by a battery terminal coupled to the fuse terminal 632*d*), and may be distributed to the fuse terminals 632*a-c* and 632*e*. If the fusible element 641 is fused, such as may occur if there is an overcurrent condition in an electrical component that is connected to one of the fuse terminals 632*a*, 632*b*, current flowing to both of the fuse terminals 632*a*, 632*b* connected to the first portion 637 of the bus bar 634 may be arrested, while current is still allowed to flow to the fuse terminals 632*c*, 632*e* connected to the second portion 639 of the bus bar 634.

Figure 13A:
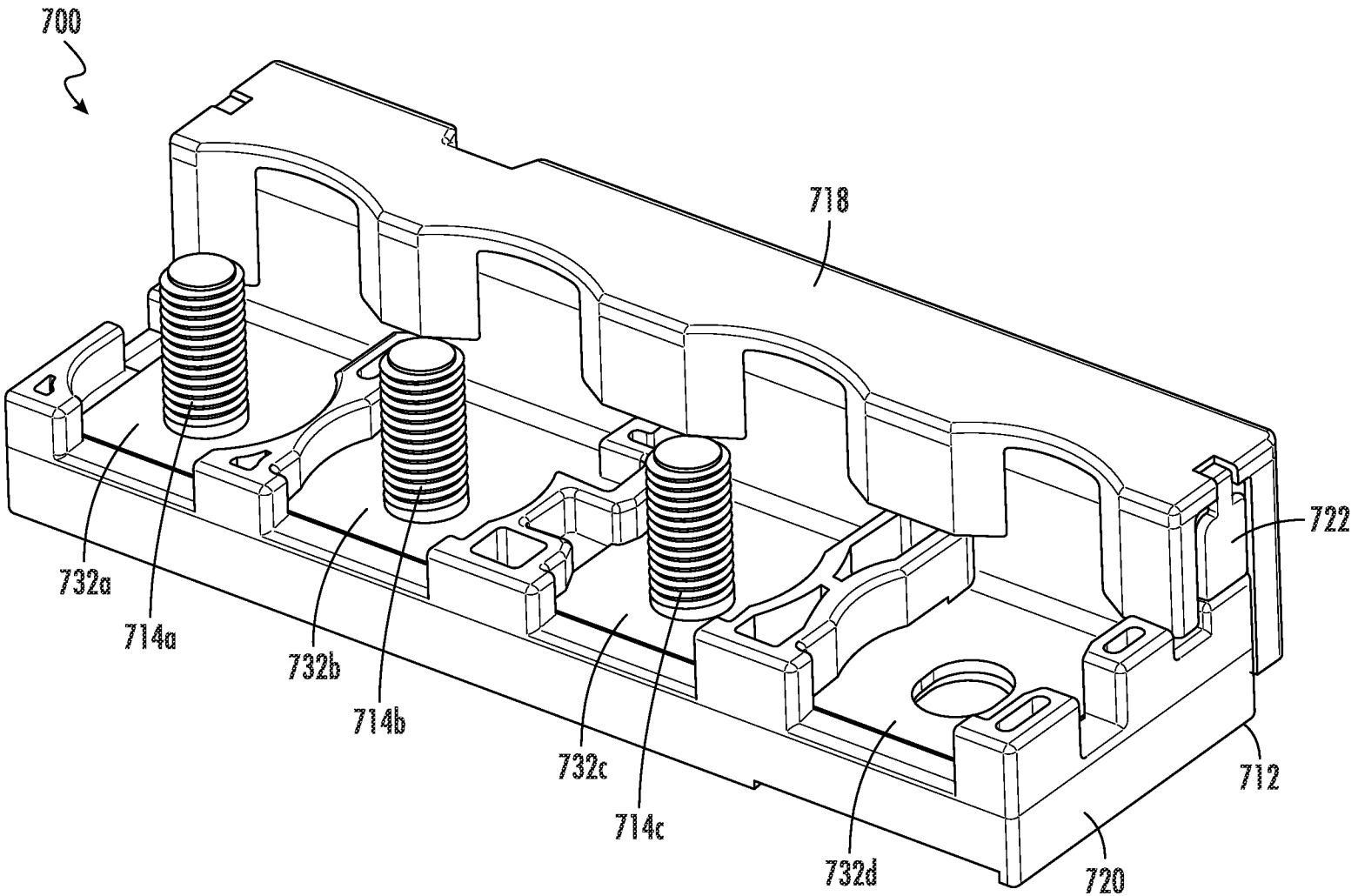
FIGS. 13*a* and 13*b* are a series of perspective views illustrating another embodiment of a fuse module in accordance with the present disclosure.
Figure 13B:
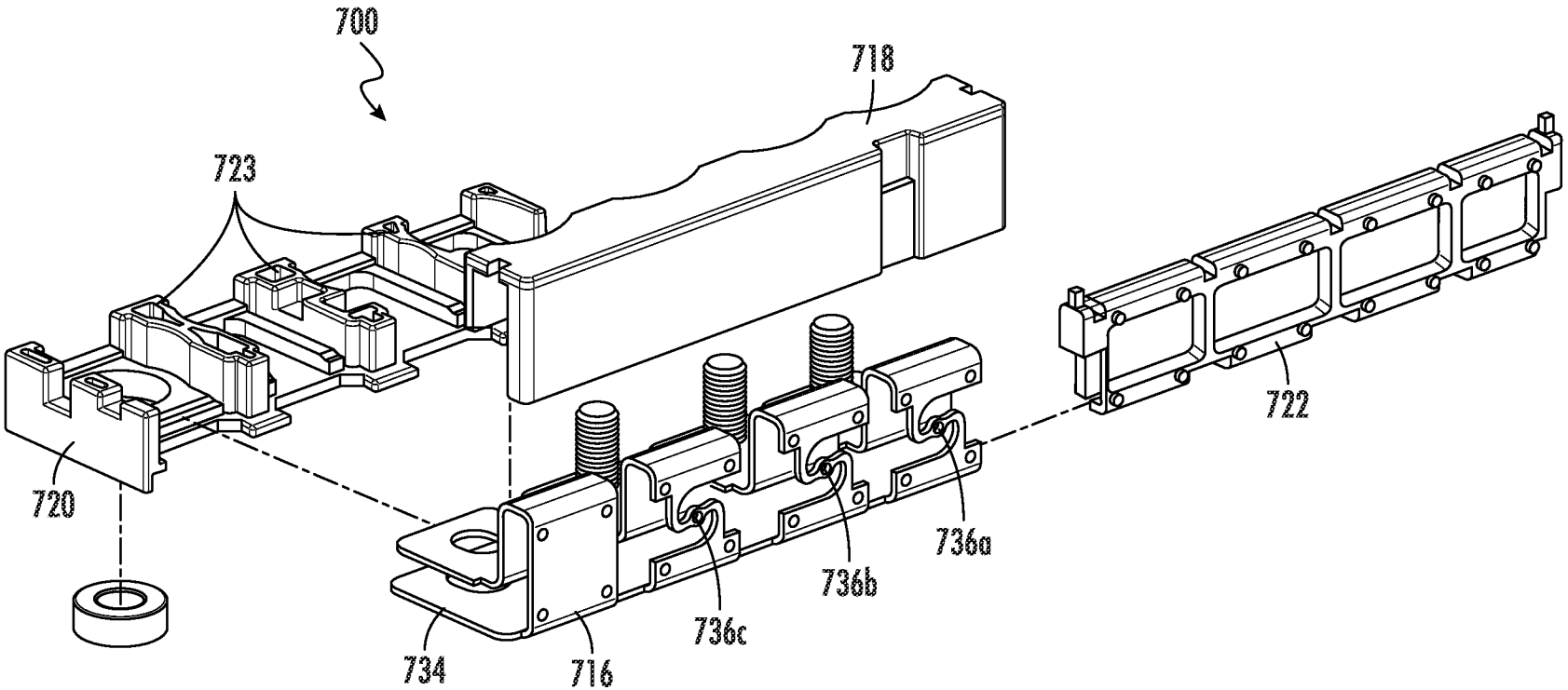

Referring to FIG. 13*a*, a fuse module 700 in accordance with another exemplary embodiment of the present disclosure is shown. The fuse module 700 may be substantially similar to the fuse module 200 described above (shown in FIG. 8*a*), and may include a mounting block 712, a plurality of terminal posts 714*a*, 714*b*, 714*c*, a fuse plate 716, and a cover 718, wherein the fuse plate 716 is wrapped or folded about the mounting block 712 in a conformal relationship with exterior surfaces thereof. Referring to FIG. 13*b*, the fuse module 700 differs from the above described fuse module 200 in that the mounting block 712 may be a modular structure that includes a plurality of separate components that are disposed adjacent, and in abutment with, one another (and optionally joined/bonded together). For example, the mounting block 712 may include a base portion 720 disposed between the bus bar 734 and the fuse terminals 732*a*, 732*b*, 732*c* and input terminal 732*d*, and a separate rear wall portion 722 oriented perpendicular to the base portion 720 and disposed adjacent the fusible elements 736*a*, 736*b*, 736*c*. The base portion 720 may include keying features 723 for facilitating routing of cables/wires to the fuse terminals 732*a*, 732*b*, 732*c* and input terminal 732*d* in a desired manner. The modular configuration of the mounting block 712 may simplify the manufacture of the mounting block 712 and/or the assembly of the fuse module 700 relative to equivalent mono-structure mounting blocks.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse module comprising:

a mounting block formed of an electrically insulating material, the mounting block including a rear wall extending from a base;

a fuse plate comprising:

an electrically conductive bus bar disposed on a bottom of the base;

a fusible element electrically connected to the electrically conductive bus bar and disposed adjacent a rear of the rear wall; and a fuse terminal electrically connected to the fusible element and extending over a top of the rear wall, along a front of the rear wall, and onto a top of the base; and an electrically conductive terminal post extending from the top of the base through the fuse terminal for facilitating connection to an electrical component; and a crimping tab extending from the electrically conductive bus bar and around a crimping flange extending from the mounting block for securing the fuse plate to the mounting block.

2. The fuse module of claim 1, wherein a portion of the electrically conductive bus bar extends beyond a longitudinal end of the mounting block and has a mounting aperture formed therethrough.

3. The fuse module of claim 1, wherein a portion of the fuse plate is embedded within the mounting block.

4. The fuse module of claim 1, wherein the fuse terminal is a first fuse terminal and the fusible element is a first fusible element, the fuse module further comprising:

a second a fusible element electrically connected to the electrically conductive bus bar and disposed adjacent the rear of the rear wall;

a second fuse terminal electrically connected to the second fusible element and extending over the top of the rear wall, along the front of the rear wall, and onto the top of the base; and a tubular sleeve disposed within the base between, and in contact with, the electrically conductive bus bar and the second fuse terminal, Wherein an aperture extends through the electrically conductive bus bar, the tubular sleeve, and the second fuse terminal.

5. The fuse module of claim 4, wherein the tubular sleeve is formed of an electrically conductive material.

6. The fuse module of claim 4, wherein the tubular sleeve is formed of an electrically insulating material.

7. The fuse module of claim 1, further comprising an electrically conductive battery clamp extending from the electrically conductive bus bar.

8. The fuse module of claim 1, further comprising a bus extension extending from the electrically conductive bus bar and having an edge adapted to mate with a terminal of a fuse.

9. The fuse module of claim 1, wherein the electrically conductive bus bar comprises a first portion and a second portion connected to one another by a fusible element.

10. The fuse module of claim 1, wherein the base of the mounting block and the rear wall of the mounting block are separate, modular components disposed in abutment with one another.

11. A fuse module comprising:

a mounting block formed of an electrically, insulating material and having a trough formed in a top surface thereof;

a fuse plate comprising:

an electrically conductive electrically conductive bus bar disposed on a bottom of the mounting block;

a first fusible element electrically connected to the electrically conductive bus bar and extending over through;

a first fuse terminal disposed on the top surface of the mounting block and electrically connected to the fusible element;

a second fusible element electrically connected to the electrically conductive bus liar and extending over the trough;

a second fuse terminal disposed on the top surface of the mounting block and electrically connected to the second fusible element; and a tubular sleeve disposed within the mounting block between, and in contact with, the electrically conductive bus bar and the second fuse terminal, wherein an aperture extends through the electrically conductive bus bar, the tubular sleeve, and the second fuse terminal; and an electrically conductive terminal post extending from the mounting block through the fuse terminal for facilitating connection to an electrical component.

12. The fuse module of claim 11, wherein a portion of the electrically conductive bus bar extends beyond a longitudinal end of the mounting block and has a mounting aperture formed therethrough.

13. The fuse module of claim 11, further comprising a cover disposed on top of the fusible element and the trough and affixed to the mounting block.

14. A fuse module comprising:

a mounting block formed of an electrically insulating material, the mounting block including a rear wall extending from a base;

a fuse plate comprising: an electrically conductive bus bar disposed on a bottom of the base;

a fusible element electrically connected to the electrically conductive bus bar and disposed adjacent a rear of the fear wall; and a fuse terminal electrically connected to the fusible element and extending over a top of the rear wall, along a front of the rear wall, and onto a top of the base; and a tubular sleeve disposed within the base between, and in contact with, the electrically conductive bus bar and the fuse terminal, wherein an aperture extends through the electrically conductive bus bar, the tubular sleeve, and the fuse terminal.

15. The fuse module of claim 14, further comprising a cover disposed over the fusible element and affixed to the rear wall.

* * * * *